US011354996B1

(12) United States Patent
Candelore

(10) Patent No.: US 11,354,996 B1
(45) Date of Patent: Jun. 7, 2022

(54) SOCIAL DISTANCING ALERT NOTIFICATION BASED ON LOCATION

(71) Applicant: SONY GROUP CORPORATION, Tokyo (JP)

(72) Inventor: Brant Candelore, San Diego, CA (US)

(73) Assignee: SONY GROUP CORPORATION, Tokyo (JP)

( * ) Notice: Subject to any disclaimer, the term of this patent is extended or adjusted under 35 U.S.C. 154(b) by 0 days.

(21) Appl. No.: 17/245,412

(22) Filed: Apr. 30, 2021

(51) Int. Cl.
*G08B 21/02* (2006.01)

(52) U.S. Cl.
CPC ..... *G08B 21/02* (2013.01)

(58) Field of Classification Search
CPC ..... G08B 21/02
See application file for complete search history.

(56) References Cited

U.S. PATENT DOCUMENTS

| | | | | |
|---|---|---|---|---|
| 9,424,734 | B1 | 8/2016 | Hagi et al. | |
| 2010/0245538 | A1* | 9/2010 | Marzano | H04N 7/147 348/14.12 |
| 2011/0025492 | A1 | 2/2011 | Bravo | |
| 2021/0312784 | A1* | 10/2021 | Valenti | G16H 50/30 |
| 2021/0385614 | A1* | 12/2021 | Millius | G08B 25/08 |

FOREIGN PATENT DOCUMENTS

JP 2017-070666 A 4/2017

OTHER PUBLICATIONS

Fernandez-Carames, et al., "Towards The Internet of Smart Clothing: A Review on IOT Wearables and Garments for Creating Intelligent Connected E-Textiles", Electronics, mdpi.com, vol. 7, No. 12, Dec. 7, 2018, 36 pages.
Alistair Charlton, "Review: Kangaroo Motion Sensor offers simple home security with affordable professional monitoring", Gearbrain.com, Aug. 28, 2018, 07 pages.

* cited by examiner

*Primary Examiner* — Travis R Hunnings
(74) *Attorney, Agent, or Firm* — Chip Law Group

(57) ABSTRACT

An electronic apparatus for social distancing alert notification based on location is provided. The electronic apparatus includes a first sensor mountable on a first living entity. The electronic apparatus stores information related to a plurality of detection ranges of the first sensor with respect to a plurality of specific geographic locations. The electronic apparatus acquires location information associated with the first living entity. The electronic apparatus compares the acquired location information with the plurality of specific geographic locations. The electronic apparatus sets the detection range of the first sensor from the plurality of detection ranges based on the comparison. The electronic apparatus detects a second living entity at the geo-location of the first living entity based on the detection range. The electronic apparatus controls output of a notification to the first living entity based on the detected second living entity is within the detection range of the first sensor.

20 Claims, 8 Drawing Sheets

SOCIAL DISTANCING ALERT NOTIFICATION BASED ON LOCATION

CROSS-REFERENCE TO RELATED APPLICATIONS/INCORPORATION BY REFERENCE

None.

FIELD

Various embodiments of the disclosure relate to an electronic apparatus for social distancing alert notification. More specifically, various embodiments of the disclosure relate to electronic apparatus for social distancing alert notification based on location.

BACKGROUND

Pathogens (such as viruses) associated with airborne diseases may transmit from one person to another through air. When an infected person may cough, sneeze, or talk, airborne pathogens (in the form of respiratory droplets or aerosol particles) may travel in the air for up to a few feet (for example, six feet or two meters) and may infect a healthy person nearby, in case the healthy person inhales the airborne pathogens. The World Health Organization (WHO) and the American Centers for Disease Control and Prevention (CDC) prescribes social distancing or physical distancing as a measure to minimize the spread of airborne diseases, where people may be required to maintain a physical distance of a few feet (for example, six feet or two meters) from each other at public places. Although usage of face masks may be an effective measure to reduce the spread of airborne diseases, it may not be convenient or possible to wear face masks in certain situations (such as while eating at a restaurant, exercising in a public park, or meeting other people in a conference room). In such situations, people may need to follow social distancing measures at all times to avoid the spread of the airborne diseases. However, a person may not be aware of his/her surroundings at all times, or may not become aware of another person who may be approaching from a position outside the field of view of the person, and thus may be at risk of infection. Furthermore, studies have shown that a minimum distance between people to prevent the spread of the airborne diseases may differ according to location. For example, in case of an outdoor location (such as a public park), the minimum prescribed distance may be six feet. In case of an indoor location (such as a conference room or any other enclosed space), the minimum prescribed distance may be longer than six feet. In some cases, the local health authority of every country or every city may adopt a different social distancing policy (such as 4.9 feet, 6 feet, or 6.6 feet). However, people may not be aware of such prescribed distances or may forget to follow the social distancing policy at times, thereby increasing the risk of infection.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

An electronic apparatus for social distancing alert notification based on location is provided substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Figure 1:
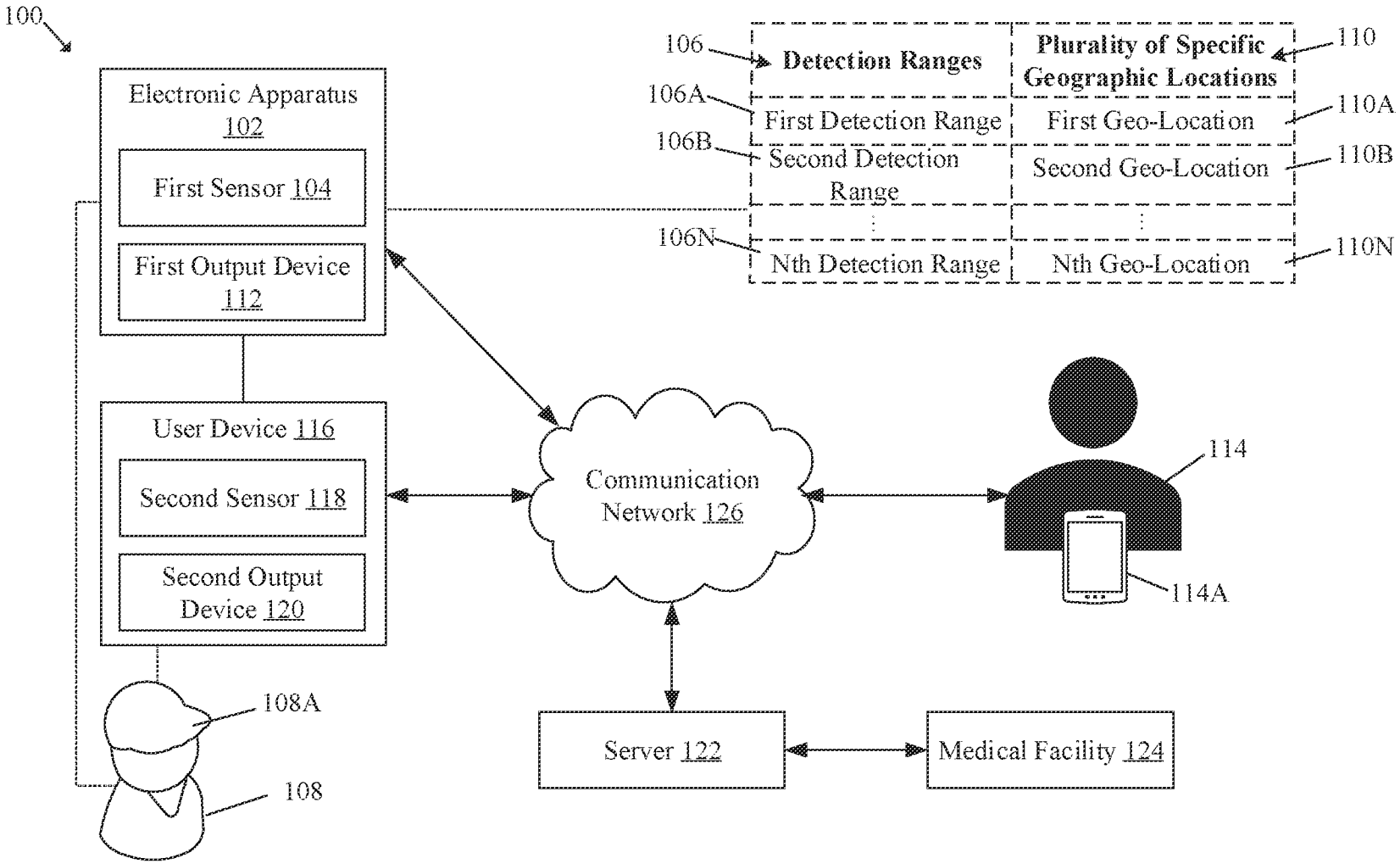
FIG. 1 is a block diagram that illustrates an exemplary network environment of an electronic apparatus to provide a social distancing alert based on a location of a first living entity, in accordance with an embodiment of the disclosure.

The following described implementations may be found in the disclosed electronic apparatus to provide a social distancing alert notification based on a location of a first living entity. The electronic apparatus may include a first sensor that may be mountable on one of the first living entity or an object (such as clothing or headgear) worn by the first living entity. The electronic apparatus may further include a memory that may be configured to store information related to a plurality of detection ranges of the first sensor with respect to a plurality of specific geographic locations (such as a public park, a conference room, or a restaurant). Each of the plurality of detection ranges may correspond to a specific geographic location of the plurality of specific geographic locations. The electronic apparatus may further include circuitry that may be communicably coupled with the first sensor. The circuitry may acquire location information associated with the first living entity. The location information may include a geo-location of the first living entity. The circuitry may further compare the acquired location information with the plurality of specific geographic locations. The circuitry may further set the detection range (for example, one meter for an open space or two meters for an enclosed space) of the first sensor from the plurality of detection ranges based on the comparison. The circuitry may further detect at least one second living entity at the geo-location of the first living entity based on the set detection range of the first sensor. The circuitry may further control output of a notification (such as a vibration notification or an audio notification) to the first living entity based on the detected at least one second living entity that is within the set detection range of the first sensor.

The disclosed electronic apparatus may set a different detection range of the first sensor based on the location (such as a public park, or a conference room) of the first living entity (such as a user), and notify the user based on the detection of the second living entity within the set detection range, to thereby alert the user of another person (such as the second living entity) who may violate the social distancing policy or who may approach the user from a position outside the field of view of the user (such as from behind the user). The electronic apparatus may store the plurality of detection ranges for multiple locations (such as outdoor locations and indoor locations), and may set the detection range based on the prescribed minimum distance for the outdoor location or the indoor location. In some cases, the electronic apparatus may receive information associated with the social distancing policy (such as 4.9 feet, 6 feet, or 6.6 feet) adopted by the local health authority from a server associated with the local health authority. The electronic apparatus may store the plurality of detection ranges based on the social distancing policy adopted by the local health authority, and may set the detection range (such as 4.9 feet, 6 feet, or 6.6 feet) based on the social distancing policy adopted by the local health authority. The electronic apparatus may notify the first living entity (such as the user) based on the detection of the second living entity within the set detection range, to thereby alert the user of another person who may violate the social distancing policy adopted by the local health authority. Thus, based on the notification by the electronic apparatus, the first living entity may take a suitable precaution (such as wear a mask or move away from the second living entity) to any avoid airborne infection. Details of the notification are described, for example, in FIGS. 3A-3C, 4A-4C, 5A-5C, 6A-6C, and 7A-7D.

In another embodiment, the electronic apparatus may be configured to change the detection range based on user input. The detection range may be changed based on user input to avoid false positives in the detection of the second living entity. Details of the change in detection range, are described, for example, in FIG. 6C.

In another embodiment, the electronic apparatus may be configured to acquire at least one of directional information or visual appearance information associated with the second living entity. Based on the at least one of the acquired directional information or the acquired visual appearance information, the electronic apparatus may be configured to output a customized audio message as the notification to the first living entity. The customized audio message may clearly identify the direction from which the second living entity may approach the first living entity or the visual appearance of the second visual entity that may violate the social distancing policy, and may further improve effectiveness of the notification provided to the first living entity. Details of the customized message are described, for example, in FIG. 6B.

FIG. 1 is a block diagram that illustrates an exemplary network environment of an electronic apparatus to provide a social distancing alert based on a location of a first living entity, in accordance with an embodiment of the disclosure. With reference to FIG. 1, there is shown a network environment 100. In the network environment 100, there is shown an electronic apparatus 102. The electronic apparatus 102 may include a first sensor 104. The electronic apparatus 102 may further include a first output device 112. In the network environment 100, there is further shown a user device 116 associated with the first living entity 108. The user device 116 may include a second sensor 118 and a second output device 120. In the network environment 100, there is further shown a server 122 associated with a medical facility 124. In the network environment 100, there is further shown a user device 114A associated with the second living entity 114. The electronic apparatus 102 may be communicably coupled with the user device 116, the server 122, or the user device 114A via a communication network 126. Modifications, additions, or omissions may be made to FIG. 1 without departing from the scope of the present disclosure.

The network environment 100 may be an exemplary representation of components (such as the user device 116 associated with the first living entity 108, the user device 114A associated with the second living entity 114, or the server 122 associated with a medical facility 124), which may be communicably coupled with the electronic apparatus 102, via the communication network 126. In an example, the network environment 100 may be shown as a star network that may include a connection of all the components to a single hub (such as the communication network 126). It may be noted that the star network shown in FIG. 1 is presented merely as an example of the network environment 100. The present disclosure may be also applicable to other types of network environment such as a bus network environment, a ring network environment, a peer-to-peer network environment, and the like. The description of other types of network environment 110 has been omitted from the disclosure for the sake of brevity.

The electronic apparatus 102 may include suitable logic, circuitry, and interfaces that may be configured to provide a social distancing alert based on the geo-location of the first living entity 108. For example, electronic apparatus 102 may be configured to output a notification to the first living entity 108 based on the detection that the second living entity 114 is within the set detection range of the first sensor 104. The notification may comprise an audio-based notification, a visual notification, or a vibration-based notification. Details of the notification by the electronic apparatus 102 are further described, for example, in FIGS. 4A-4C, 5A-5C, 6A-6C, and 7A-7D. In another embodiment, the electronic apparatus 102 may be implemented as a mobile device that may be communicably coupled with at least one of the user device 114A or the server 122. Examples of the electronic apparatus 102 may include, but are not limited to, a computing device, a mainframe machine, a computer workstation, a mobile phone, a smart phone, a tablet computing device, a personal computer, a smart audio device, a server, and/or a portable consumer electronic (CE) device with communication and information processing capability.

In an embodiment, the electronic apparatus 102 may be implemented as a smart wearable apparatus that may be mounted on the first living entity 108 or an object 108A worn by the first living entity 108. In an embodiment, the smart wearable apparatus may be mounted on or attached to the object 108A (such as a shirt, a jacket, a headgear) worn by the first living entity 108 at various positions (such as shoulder, arm, leg, or head) of the first living entity 108. In another embodiment, the smart wearable apparatus may be directly mounted to a part (such as a hand, a head, etc.) of the first living entity 108. In some embodiments, the electronic apparatus 102 may include an application that may be associated with a user interface to control the power supply (ON/OFF) of the electronic apparatus 102, the detection range of the first sensor 104, the parameters (such as volume, vibration intensity, etc.) of the first output device 112, and so on. In an example, the electronic apparatus 102 may download the application from a cloud server (such as the server 122). In another example, the electronic apparatus 102 may include the application that may be pre-installed by a manufacturer of the electronic apparatus 102. In another embodiment, the functionalities (such as ON/OFF, the detection range of the first sensor 104, or the parameters of the first output device 112) of the electronic apparatus 102 may be controlled remotely by the user device 116 (such as a mobile phone) associated with the first living entity 108. In an example, the electronic apparatus 102 may include a mounting mechanism (such as flexible shoulder mount, a strap with a hook-and-loop fastener, a strap with a buckle or folding clasp, etc.) configured to mount or attach the electronic apparatus 102 to the first living entity 108. The mounting mechanism may be detachably attached to the electronic apparatus 102 or may be integrally formed with the electronic apparatus 102. Examples of the electronic apparatus 102 may further include, but are not limited to, a watch, a bracelet, an armband, a headband, a necklace, a chest band, a waistband, a knee band, or an ankle band.

In an embodiment, the electronic apparatus 102 may include a location sensor that may be configured to detect the geo-location of the first living entity 108. The location sensor may be further configured to output information associated with the current geo-location of the first living entity 108. In another embodiment, the location sensor may be communicably coupled with the electronic apparatus 102, via the communication network 126. The location sensor may be related to a Global Navigation Satellite System (GNSS). Examples of the GNSS-based location sensor may include, but are not limited to, a Galileo Navigation System, a Global Positioning System (GPS), a Global Navigation Satellite System (GLONASS), a Bei-Dou Navigation Satellite System, or other regional navigation systems or sensors. In embodiment, the location sensor may be configured to output the information associated with the geo-location of the first living entity 108, based on the movement of the first living entity 108 between the plurality of specific geographic locations 110.

The first sensor 104 may include suitable logic, circuitry, and interfaces that may be configured to detect at least one second living entity (such as the second living entity 114) at a geo-location of the first living entity 108 based on a detection range of the first sensor 104. The detection range of the first sensor 104 may correspond to the geo-location of the first living entity 108. Upon detection of the second living entity 114, the first sensor 104 may transmit information (such as a detection output) associated with the detected second living entity 114 to the electronic apparatus 102. Examples of the first sensor 104 may include, but are not limited to, a thermal sensor, an audio sensor, an ultrasonic sensor, a photosensor, an image sensor, a 360-degree camera, an optical sensor, an event camera, a light detection and ranging (LiDAR) sensor, or a radio frequency identification tag (RFID) reader. In an embodiment, the detection range of the first sensor 104 may be switched between the plurality of detection ranges 106 by using one or more amplifiers configured to controllably increase a sensitivity of the first sensor 104. In an embodiment, the first sensor 104 may be coupled to a noise filter to eliminate undesired noise in the output of the first sensor 104.

In one embodiment, the first sensor 104 may be implemented as the thermal sensor. The thermal sensor may include an infrared sensor that may detect infrared radiation emitted by the at least one second living entity (such as the second living entity 114) located within the detection range. Upon detection of the infrared radiation, the thermal sensor may output information associated with a change in the detected infrared radiation to the electronic apparatus 102. Based on the detected infrared radiation, the electronic apparatus 102 may determine a temperature value associated with the second living entity 114 to detect the second living entity 114. In accordance with an embodiment, the thermal sensor may be mounted on the first living entity 108 to detect the second living entity 114. Details of the thermal sensor are further explained, for example in FIGS. 4A-4C. Examples of the thermal sensor may include, but are not limited to, a passive infrared (PIR) sensor, an infrared (IR) sensor, a thermographic camera, a thermocouple, a resistance temperature detector (RTD), a thermistor, a pyrometer, or a semiconductor-based temperature sensor.

In another embodiment, the first sensor 104 may be implemented as the image sensor. The image sensor may include an imaging element that may be configured to capture an image or a plurality of images of the second living entity 114 located within the detection range. Based on the capture of the image or the plurality of images of the second living entity 114, the imaging sensor may output information associated with the captured image or the plurality of images of the second living entity 114. The electronic apparatus 102 may determine a distance of the second living entity 114 from the first sensor 104 to detect the second living entity 114 within the detection range. In accordance with an embodiment, the image sensor may be mounted on the first living entity 108 to detect the second living entity 114. In an embodiment, the detection range of the image sensor may be set based on distance measurement with respect to objects in the captured image. For example, the image sensor may be configured to output the information of the second living entity 114 based on the measured distance in the captured image is within the set detection range (such as two meters) of the first sensor 104. Details of the image sensor are further explained, for example in FIGS. 5A-5C. Examples of the image sensor may include, but are not limited to, a wide-angle camera, an action camera, an event camera, a closed-circuit television (CCTV) camera, a camcorder, a digital camera, camera phones, a time-of-flight camera (ToF camera), a night-vision camera, and/or other image capture devices.

In another embodiment, the first sensor 104 may be implemented as the 360-degree camera. The 360-degree camera may be configured to capture a 360-degree view of the surroundings of the first living entity 108. In accordance with an embodiment, the 360-degree camera may include one or more omnidirectional sensors to capture the 360-degree view of the surroundings of the first living entity 108. In an embodiment, the omnidirectional sensor may be configured to capture one or more portions (such as two 180-degree views) of the surroundings of the first living entity 108 and stitch each captured portion to generate the 360-degree view of the surroundings of the first living entity 108. Based on the generated 360-degree view, the electronic apparatus 102 may detect the second living entity 114. In accordance with an embodiment, the 360-degree camera may be mounted on the first living entity 108 to detect the second living entity 114. Details of the omnidirectional sensor are further explained, for example in FIG. 3C. Examples of the 360-degree camera may include, but are not limited to, the omnidirectional camera, a panoramic camera, an action camera, a wide-angle camera, a closed-circuit television (CCTV) camera, and/or other image capturing or devices with 360-degree view capturing capability.

In another embodiment, the first sensor 104 may be implemented as the optical sensor. The optical sensor may include a detection element (such as the photodetector) that may be configured to capture optical signals from the surroundings of the first living entity 108. In one example, the captured optical signals may comprise information associated with the second living entity 114. Based on the capture of the optical signals associated with the second living entity 114, the optical sensor may output information associated with the captured optical signals of the second living entity 114. Based on the captured optical signals, the electronic apparatus 102 may determine a distance of the second living entity 114 from the first sensor 104. In accordance with an embodiment, the optical sensor may be mounted on the first living entity 108 to detect the second living entity 114. Details of the optical sensor are further explained, for example in FIGS. 4A-4C. Examples of the optical sensor may include, but are not limited to, the photodetector, a fiber optic sensor, a proximity detector, an ambient light sensor, a Light Emitting Diode (LED) sensor, a light amplification by stimulated emission radiation (LASER) sensor, etc. In an embodiment, the electronic apparatus 102 may control the first sensor 104 to set the detection range from a plurality of detection ranges 106.

The plurality of detection ranges 106 (such as a few feet or a few meters) may correspond to the plurality of specific geographic locations 110. For example, the plurality of detection ranges 106 may include a first detection range 106A, a second detection range 106B, and a Nth detection range 106N. In an embodiment, the detection range of the first sensor 104 may be directly proportional to a sensitivity value of the first sensor 104. For example, a higher sensitivity value of the first sensor 104 may cause the first sensor 104 to detect the second living entity 114 at a larger detection range (such as a range of 2 meters) from the first sensor 104. In another example, a lower sensitivity value of the first sensor 104 may cause the first sensor 104 to detect the second living entity 114 at a shorter detection range (such as a range of 1 meter) from the first sensor 104. Examples of the plurality of detection ranges 106 that may correspond to the plurality of specific geographic locations 110 are shown in Table 1:

TABLE 1

Correspondence between the plurality of detection ranges 106 and the plurality of specific geographic locations 110

| ON/OFF State of Electronic Apparatus 102/ Detection Range 106 (Feet) | Specific Geographic Location 110 |
|---|---|
| OFF/0 feet | Living Room |
| ON/6.6 feet | Office/Conference Room |
| ON/6 feet | Public Park |
| ON/7 feet | Indoor Restaurant |
| ON/6.6 feet | Supermarket |
| ON/6 feet | Street Sidewalk |

The plurality of detection ranges 106, shown in FIG. 1 and Table 1 are presented merely as an example. In another example, the plurality of detection ranges 106 may include one detection range or more than one detection range, without deviation from the scope of the disclosure. In an embodiment, the electronic apparatus 102 may receive information associated with the plurality of detection ranges 106 from the server 122. In another embodiment, the electronic apparatus 102 may generate the information associated with the plurality of detection ranges 106 based on the social distancing policy (for each location) received from the server 122. In another embodiment, the electronic apparatus 102 may generate the information associated with the plurality of detection ranges 106 based on user input.

The first living entity 108 may be a human or an animal on whom the electronic apparatus 102 may be mounted. For example, the electronic apparatus 102 may notify the first living entity 108 based on the detection of the second living entity 114, within the detection range of the first sensor 104 of the electronic apparatus 102. In an embodiment, the electronic apparatus 102 may be mounted directly on the skin of the first living entity 108. In another embodiment, the electronic apparatus 102 may be mounted on an object 108A worn by the first living entity 108.

The object 108A may be an article of clothing or an accessory worn by the first living entity 108. Examples of the article of clothing may include, but are not limited to, a shirt, a suit, a jacket, pants, shorts, a raincoat, a wind cheater, a tie, and the like. Examples of the accessory may include, but are not limited to, a cap, a necklace, a bracelet, a shoe, a straddle strap, a garment, a watch, an eyeglass, a helmet, and the like. The object 108A shown in FIG. 1 is presented merely as an example. In another example, the object 108A may be coupled with at any part (such as a head, a hand, a leg, a neck, a torso, a shoulder, a chest, a foot, and the like) of the first living entity 108. In an embodiment, the electronic apparatus 102 may be coupled to the object 108A.

The plurality of specific geographic locations 110 may correspond to multiple locations where the first living entity 108 may frequently or non-frequently visit. For example, the plurality of specific geographic locations 110 may include a first geo-location 110A, a second geo-location 1108, and a Nth geo-location 110N. Examples of the plurality of specific geographic locations 110 frequently visited by the first living entity 108 are shown in Table 1. The plurality of specific geographic locations 110, shown in FIG. 1 and Table 1 are presented merely as an example. In another example, the plurality of specific geographic locations 110 may include one geo-location or more than one geo-location, without deviating from the scope of the disclosure. Examples of the plurality of specific geographic locations 110 may include, but are not limited to, a public park, a conference room, a hospital, a clinic, a restaurant, a store, a mall, an ATM enclosure, a residence of the first living entity 108, a residence of a relative or a friend, etc. In an embodiment, information associated with each of the plurality of specific geographic locations 110 may be stored in the electronic apparatus 102, for the comparison with the geo-location received from the location sensor associated with the electronic apparatus 102. Based acquired location information, the electronic apparatus 102 may retrieve a first detection range of the plurality of detection ranges 106, and may set the detection range of the first sensor 104 based on the retrieved first detection range.

The first output device 112 may include suitable logic, circuitry, and/or interfaces that may be configured to provide the notification (such as the social distancing alert) to the first living entity 108. The first output device 112 may include an a suitable I/O device (such as a speaker, a display screen, or a vibration actuator) to output at least one of the audio-based notification, the visual notification, or the vibration-based notification, respectively. Details of the notification from the first output device 112, are further described, for example, in FIGS. 6A-6C. In an embodiment, the first output device 112 may be integrally coupled with the electronic apparatus 102 to provide the notification to the first living entity 108. In another embodiment, the first output device 112 may be remotely coupled with the electronic apparatus 102, via the communication network 126. Examples of the first output device 112 may include, but are not limited to, a speaker, a display screen, a touch screen, a vibration actuator, a transducer, a projector, etc. In an embodiment, the electronic apparatus 102 may further notify the second living entity 114, based on the acquired location information associated with the first living entity 108. In an embodiment, the first output device 112 may include a head-mounted display, and the notification may include a virtual object superimposed on a real world view.

The second living entity 114 may be a human or an animal that may visit at least one geo-location of the plurality of specific geographic locations 110. In one example, the electronic apparatus 102 may notify the first living entity 108 to maintain the minimum distance from the second living entity 114. In another example, the electronic apparatus 102 may notify the second living entity 114, based on the detection of the second living entity 114 within the detection range of the first sensor 104 of the electronic apparatus 102. In an embodiment, the electronic apparatus 102 may notify the second living entity 114 via the user device 114A associated with the second living entity 114.

The user device 114A may include suitable logic, circuitry, and/or interfaces that may be configured to notify the second living entity 114, based on the detection of the second living entity 114 within the detection range of the first sensor 104. The functionality and configuration of the user device 114A may be similar to the functionality and configuration of the user device 116. In one example, the notification may relate to a request for the second living entity 114 to maintain the minimum distance from the first living entity 108. In an embodiment, the user device 114A may be mounted to a part (such as a hand) of the second living entity 114. The user device 114A may include an application that may have a user interface to control the notification to the second living entity 114. Examples of the user device 114A may include, but are not limited to, a computing device, a smartphone, a cellular phone, a tablet computer, a mobile phone, and other portable devices.

The user device 116 may include suitable logic, circuitry, and/or interfaces that may be configured to notify the first living entity 108, based on the detection of the second living entity 114. The functionality and configuration of the user device 116 may be similar to the functionality and configuration of the user device 114A. In an example, the notification may be related the social distancing alert for the first living entity 108 about the second living entity 114 approaching the first living entity 108. In an embodiment, the user device 116 may be carried by or mounted on a part (such as a hand) of the first living entity 108. In some embodiments, the user device 116 may include an application that may be associated with a user interface to remotely control the power supply (ON/OFF) of the electronic apparatus 102, the detection range of the first sensor 104, the parameters (such as volume, vibration intensity, etc.) of the first output device 112, and other functionalities and parameters of the electronic apparatus 102. In an example, the application may be downloaded to the user device 116 from a cloud server (such as the server 122). In another example, the user device 116 may include the application that may be pre-installed by a manufacturer of the user device 116. Examples of the user device 116 may include, but are not limited to, a computing device, a smartphone, a cellular phone, a mobile phone, a tablet computer, and other portable devices.

In an embodiment, based acquired location information, the electronic apparatus 102 may control the second sensor 118 of the user device 116 to detect the second living entity 114. The functionalities of the second sensor 118 may be same as the functionalities of the first sensor 104 described, for example, in FIG. 1. Therefore, the description of the second sensor 118 is omitted from the disclosure for the sake of brevity. The electronic apparatus 102 may further control the second output device 120 of the user device 116 to provide the notification to the first living entity 108 based on the detection of the second living entity 114. The functionalities of the second output device 120 may be the same as the functionalities of the first output device 112 described, for example, in FIG. 1. Therefore, the description of the second output device 120 is omitted from the disclosure for the sake of brevity.

In an embodiment, the server 122 may be a cloud server, which may be utilized to execute various operations through web applications, cloud applications, HTTP requests, repository operations, file transfer, and the like. In one or more embodiments, the server 122 may be implemented as a plurality of distributed cloud-based resources to receive the notification from the electronic apparatus 102. Examples of the server 122 may include, but are not limited to, an event server, a database server, a file server, a web server, a media server, a content server, an application server, a mainframe server, or a combination thereof. In an embodiment, the server 122 may be configured to be communicably coupled with the medical facility 124. In an embodiment, the server 122 may be configured to store information related to the social distancing policy (such as 4.9 feet, 6 feet, or 6.6 feet) prescribed by the local health authority for each city or country. In another embodiment, the server 122 may be configured to store information related to the minimum prescribed distances for specific indoor and outdoor locations.

The medical facility 124 may include a suitable infrastructure, medical equipment, and medical professionals that may be configured to validate a notification from the electronic apparatus 102. The medical facility 124 may include a communication device (such as a mobile device, a broadcasting device, etc.) that may be configured to communicate with at least one of the electronic apparatus 102, the user device 116, or the user device 114A to validate the notification received from the electronic apparatus 102. In another embodiment, the server 122 associated with the medical facility 124 may communicate with the at least one of electronic apparatus 102, the user device 116, or the user device 114A, via the communication network 126.

The communication network 126 may include a communication medium through which the electronic apparatus 102, the user device 114A associated with the second living entity 114, the user device 116 associated with the first living entity 108, and the server 122 associated with the medical facility 124, may communicate with each other. The communication network 126 may be one of: a wired connection or a wireless connection. Examples of the communication network 126 may include, but are not limited to, the Internet, a cloud network, a Wireless Fidelity (Wi-Fi) network, a Personal Area Network (PAN), a Local Area Network (LAN), or a Metropolitan Area Network (MAN). Various devices in the network environment 100 may be configured to connect to the communication network 126 in accordance with various wired and wireless communication protocols.

Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

In operation, the electronic apparatus 102 may acquire location information associated with the first living entity 108. For example, the location information may be acquired from the location sensor that may be associated with the electronic apparatus 102. The location information may include the geo-location (such as the first geo-location 110A) of the first living entity 108. The electronic apparatus 102 may further compare the acquired location information with the plurality of specific geographic locations 110. The electronic apparatus 102 may further set the detection range of the first sensor 104 from the plurality of detection ranges 106 based on the comparison. The electronic apparatus 102 may further detect the at least one second living entity (such as the second living entity 114) at the geo-location (such as the first geo-location 110A) of the first living entity 108 based on the set detection range of the first sensor 104. The electronic apparatus 102 may further control the output of the notification to the first living entity 108 based on the detected at least one second living entity (such as the second living entity 114) that may be within the set detection range of the first sensor 104.

Thus, the disclosed electronic apparatus 102 may set a different detection range of the first sensor 104 based on the location (such as a public park, or a conference room) of the first living entity 108 (such as a user). The disclosed electronic apparatus may notify the first living entity 108 based on the detection of the second living entity 114 within the set detection range, to thereby alert the first living entity 108 of another person (such as the second living entity 114) who may violate the social distancing policy or who may approach the first living entity 108 from a position outside the field of view of the first living entity 108 (such as from behind the first living entity 108). The electronic apparatus 102 may store the plurality of detection ranges 106 for multiple locations (such as outdoor locations and indoor locations), and may set the detection range based on the prescribed minimum distance for the outdoor location or the indoor location. In some cases, the electronic apparatus 102 may receive information associated with the social distancing policy (such as 4.9 feet, 6 feet, or 6.6 feet) adopted by the local health authority from the server 122. The electronic apparatus 102 may store the plurality of detection ranges 106 based on the social distancing policy adopted by the local health authority, and may set the detection range based on the social distancing policy adopted by the local health authority. The electronic apparatus 102 may notify the first living entity 108 based on the detection of the second living entity 114 within the set detection range, to thereby alert the user of another person (such as the second living entity 114) who may violate the social distancing policy. Thus, based on the notification by the electronic apparatus 102, the first living entity 108 may take a suitable precaution (such as wear a mask or move away from the second living entity) to any avoid airborne infection.

The electronic apparatus 102 may be configured to control the output of the notification to the first living entity 108, based on a determination that the at least one second living entity (such as the second living entity 114) is approaching the first living entity 108 within the set detection range of the first sensor 104. The electronic apparatus 102 may be further configured to control one of the first output device 112 or the second output device 120 to output the notification. The first output device 112 may include at least one of a display device, a first speaker, or a first vibration actuator, to provide a visual notification, an audible notification, or the vibratory notification, respectively. The second output device may include at least one of a second speaker or a second vibration actuator, to provide a visual notification, an audible notification, or the vibratory notification, respectively. Details of the notification are further described, for example, in FIGS. 4A-4C, 5A-5C, 6A-6C, and 7A-7D.

Figure 2:
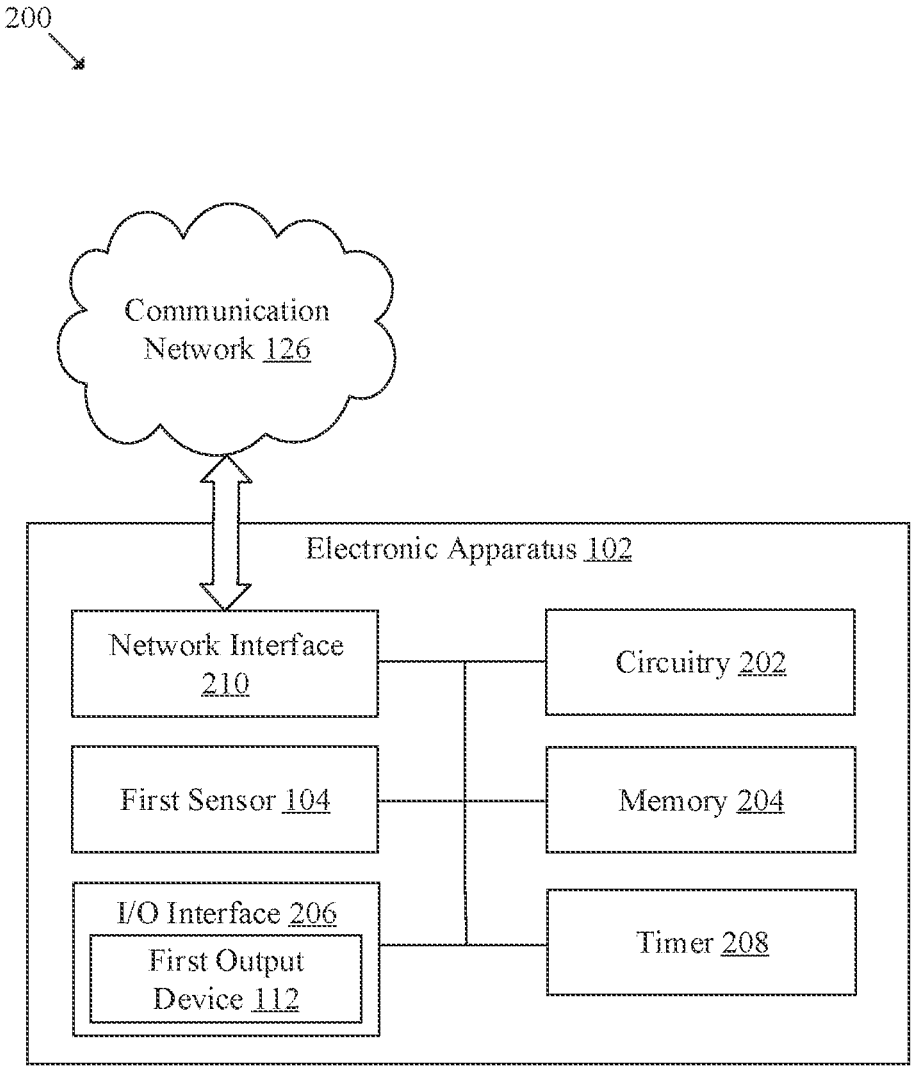
FIG. 2 is a block diagram that illustrates an exemplary architecture of an electronic apparatus to provide a social distancing alert based on a location of a first living entity, in accordance with an embodiment of the disclosure.

FIG. 2 is a block diagram that illustrates an exemplary architecture of an electronic apparatus to provide a social distancing alert based on a location of a first living entity, in accordance with an embodiment of the disclosure. FIG. 2 is explained in conjunction with elements from FIG. 1. With reference to FIG. 2, there is shown a block diagram 200 of the electronic apparatus 102. The electronic apparatus 102 may include circuitry 202, a memory 204, a I/O interface 206, a timer 208, the first sensor 104, and a network interface 210. In some embodiments, the electronic apparatus 102 may be communicably coupled with at least one of the user device 114A associated with the second living entity 114, the second output device 120 of the user device 116, or the server 122 associated with the medical facility 124, via the communication network 126.

The circuitry 202 may include suitable logic, circuitry, and/or interfaces that may be configured to execute program instructions associated with different operations to be executed by the electronic apparatus 102. For example, some of the operations may include, but are not limited to, acquisition of location information associated with the first living entity 108, comparison of the acquired location information with the plurality of specific geographic locations 110 (for example, stored in the memory 204), setting of the detection range of the first sensor 104 from the plurality of detection ranges 106 based on the comparison, detection of the at least one second living entity (such as the second living entity 114) at the geo-location (such as the first geo-location 110A) of the first living entity 108 based on the set detection range of the first sensor 104, and control of the output of the notification to the first living entity 108 based on the detected at least one second living entity (such as the second living entity 114) that may be disposed within the set detection range of the first sensor 104. The execution of operations may be further described, in FIGS. 4A-4C, 5A-5C, 6A-6C, and 7A-7D.

The circuitry 202 may include any suitable special-purpose or general-purpose computer, computing entity, or processing device including various computer hardware or software modules and may be configured to execute instructions stored on any applicable computer-readable storage media (for example, the memory 204). The circuitry 202 may be implemented based on several processor technologies known in the art. For example, the circuitry 202 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data. The circuitry 202 may include any number of processors configured to, individually or collectively, perform any number of operations of the electronic apparatus 102, as described in the present disclosure. Examples of the circuitry 202 may include a Central Processing Unit (CPU), a Graphical Processing Unit (GPU), an x86-based processor, an x64-based processor, a Reduced Instruction Set Computing (RISC) processor, a Complex Instruction Set Computing (CISC) processor, and/or other hardware processors.

The memory 204 may include suitable logic, circuitry, interfaces, and/or code that may be configured to store the set of instructions executable by the circuitry 202. In an embodiment, the memory 204 may be configured to store the information associated with the plurality of specific geographic locations 110 (such as the first geo-location 110A). The memory 204 may be further configured to store the information related to the plurality of detection ranges 106 in association with the plurality of specific geographic locations 110. Each of the stored plurality of detection ranges 106 (such as the first detection range 106A), stored in the memory 204, may correspond to a specific geographic location (such as the first geo-location 110A) of the plurality of specific geographic locations 110. Similarly, the second detection ranges 106B of the plurality of the detection ranges 106, stored in the memory 204, may correspond to the second geo-location 110B, of the plurality of specific geographic locations 110. Further, the Nth detection range 106N of the plurality of the detection ranges 106 stored in the memory 204 may correspond to the Nth geo-location 110N of the plurality of specific geographic locations 110.

The memory 204 may be further configured to store reference temperature values associated with living entities (such as the second living entity 114). For example, the stored reference temperature values associated with living entities for detection within the set detection range (such as two meters) may be 96.4 to 102 degrees Fahrenheit. The memory 204 may be further configured to store reference images associated with living entities (such as the second living entity 114). For example, the stored reference images may include object identification data for identification of an object (such as a human being) detected in an image captured by the first sensor 104 as a human being. In an embodiment, the circuitry 202 may receive the reference temperature values and/or the reference images from the server 122, and may store the received the reference temperature values and/or the reference images in the memory 204. The memory 204 may further store one or more images of living entities (such a family and friends) known to the first living entity 108 to perform face recognition of the second living entity 114. Details of the face recognition of the second living entity 114 is further described for example, in FIG. 5B. The memory 204 may further store one or more identifiers of RFID tags associated with the user device 114A. Examples of implementation of the memory 204 may include, but are not limited to, Random Access Memory (RAM), Read Only Memory (ROM), Hard Disk Drive (HDD), a Solid-State Drive (SSD), a CPU cache, and/or a Secure Digital (SD) card.

The I/O interface 206 may include suitable logic, circuitry, interfaces, and/or code that may be configured to receive user input from the first living entity 108, and may render output in response to the received user input from the electronic apparatus 102. In an embodiment, the I/O interface 206 may be integrally coupled to the electronic apparatus 102 to receive the user input from the first living entity 108. In another embodiment, the I/O interface 206 may be communicably coupled to the electronic apparatus 102, via the communication network 126, to receive the user input from the first living entity 108. In some embodiments, the I/O interface 206 may include various input and output devices (such as the first output device 112), that may be configured to communicate with the circuitry 202. Examples of the such input and output devices may include, but are not limited to, a touchscreen, a keyboard, a mouse, a joystick, a microphone, an image sensor, a display device, a speaker, and/or a vibration actuator.

The timer 208 may include suitable logic, circuitry, interfaces, and/or code that may be configured to set a countdown timer to activate and deactivate the second sensor 118 of the user device 116, for the detection of the at least one second living entity (such as the second living entity 114). In an example, the timer 208 may include a digital counter or clock to countdown a first time period, based on instructions from the electronic apparatus 102, and may expire after the countdown of the first time period is completed. Based on the completion of the first time period, the electronic apparatus 102 may deactivate the second sensor 118. Examples of the timer 208 may include, but are not limited to, a software timer, a digital clock, or an internal clock associated with the electronic apparatus 102. In an embodiment, based on instructions from the electronic apparatus 102, the second sensor 118 of the user device 116 may be activated for the first time period that may be set by the timer 208. The electronic apparatus 102 may control the output of the notification to the first living entity 108 based on the detected at least one second living entity (such as the second living entity 114) during the first time period. The electronic apparatus 102 may be further configured to deactivate the second sensor 118 of the user device 116 upon completion of the first time period set by the timer 208.

The network interface 210 may include suitable logic, circuitry, and interfaces that may be configured to facilitate communication between the circuitry 202 and the communication network 126. For example, the circuitry 202 may communicate with the user device 116, the server 122, and the user device 114A via the network interface 210. The network interface 210 may be implemented by use of various known technologies to support wired or wireless communication of the electronic apparatus 102 with the communication network 126. Examples of the network interface 210 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, a Radio-Frequency Identification Device (RFID), a Bluetooth® Transceiver, or a local buffer circuitry. The network interface 210 may be configured to communicate via wireless communication with networks, such as the Internet, an Intranet or a wireless network, such as a cellular telephone network, a wireless local area network (LAN), and a metropolitan area network (MAN). The wireless communication may be configured to use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX), a protocol for email, instant messaging, and a Short Message Service (SMS).

Although in FIG. 2, it is shown that the electronic apparatus 102 may include the circuitry 202, the memory 204, the I/O interface 206, the timer 208, and the network interface 210; the disclosure may not be so limiting and the electronic apparatus 102 may include more or less components to perform the same or other functions of the electronic apparatus 102. Details of the other functions and the components have been omitted from the disclosure for the sake of brevity. The functions or operations executed by the electronic apparatus 102, as described in FIG. 1, may be performed by the circuitry 202. Operations executed by the circuitry 202 are described, for example, in FIGS. 4A-4C, 5A-5C, 6A-6C, and 7A-7D.

Figure 3C:
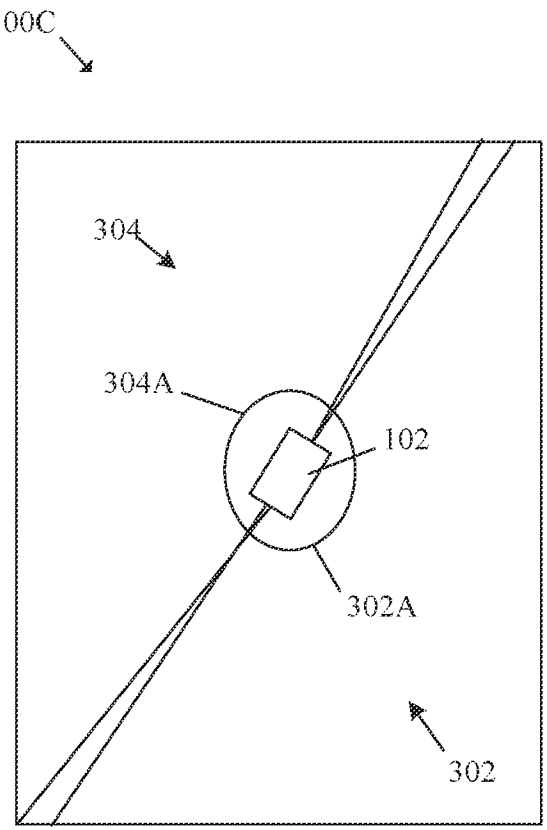
FIGS. 3A-3C are diagrams that illustrates exemplary implementations of the electronic apparatus of FIG. 1, in accordance with an embodiment of the disclosure.
Figure 3B:
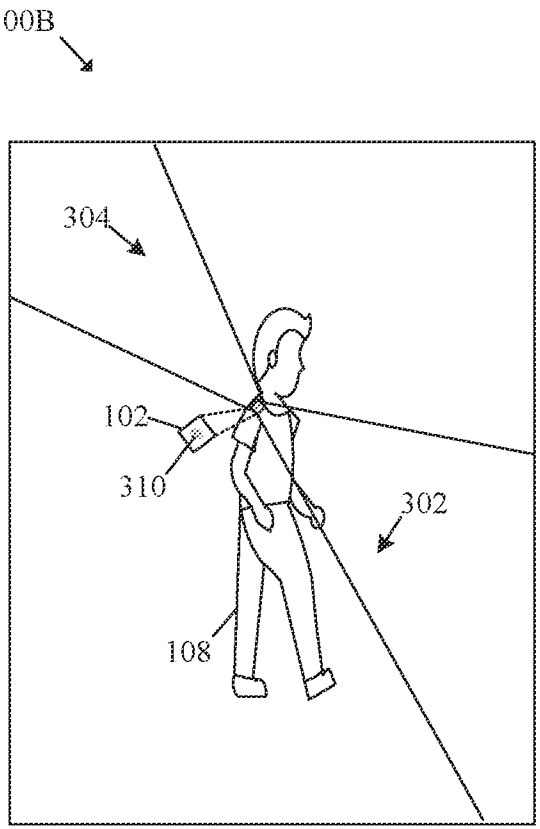
Figure 3A:
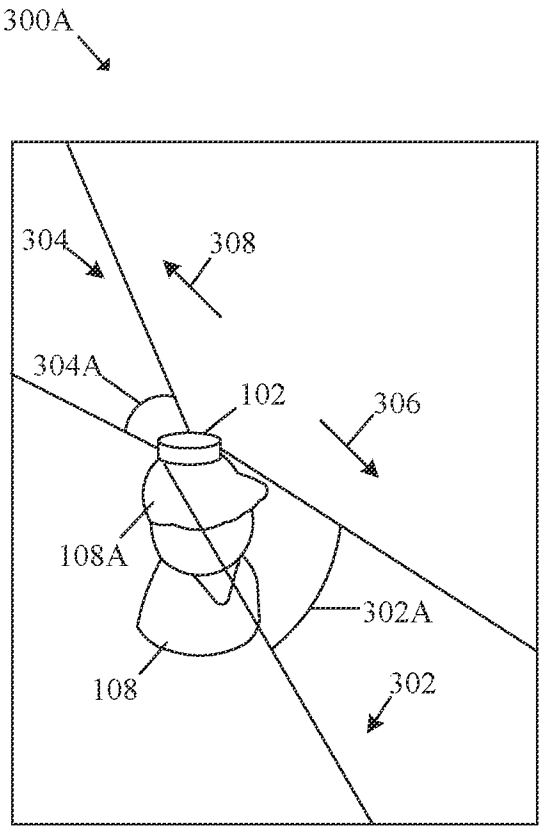

FIG. 3A is a diagram that illustrates an exemplary implementation of the electronic apparatus of FIG. 1, in accordance with an embodiment of the disclosure. FIG. 3A is explained in conjunction with elements from FIGS. 1 and 2. With reference to FIG. 3A, there is shown an exemplary scenario 300A that illustrates a first mounting configuration of the electronic apparatus 102.

In the exemplary scenario 300A, there is shown the first mounting configuration of the electronic apparatus 102. In an embodiment, the electronic apparatus 102 may be mounted on the object 108A associated with the first living entity 108. The first sensor 104 associated with the electronic apparatus 102 may be configured to have a first field-of-view 302 and a second field-of-view 304, for the detection of the second living entity 114 within the detection range of the first sensor 104. In an embodiment, the first field-of-view 302 may be substantially opposite to the second field-of-view 304. For example, the first field-of-view 302 may be along a first direction 306 and the second field-of-view 304 may be along a second direction 308. The first direction 306 may be substantially opposite to the second direction 308. In another embodiment, the first field-of-view 302 may be located adjacent to the second field-of-view 304. For example, the first field-of-view 302 may be a detection angle represented by a first angle 302A. In another example, the second field-of-view 304 may be may be a detection angle represented by a second angle 304A. In an embodiment, the first sensor 104 may comprise one or more reflectors to switch between the first field-of-view 302 and the second field-of-view 304.

In an embodiment, the electronic apparatus 102 may be coupled to the object 108A (such as a headgear) associated to the first living entity 108 using a mounting mechanism (such as flexible shoulder mount, a strap with a hook-and-loop fastener, or a strap with a buckle or folding clasp). The circuitry 202 may be configured to control the first sensor 104 to switch between the first field-of-view 302 and the second field-of-view 304 to change a direction (such as the first direction 306 or the second direction 308) of the detection of the at least one second living entity (such as the second living entity 114). For example, in case the first living entity 108 is at a tail end of a queue, the circuitry 202 may be configured to switch to the first field-of-view 302 to detect the second living entity 114 who may be in front of the first living entity 108 in the queue. In another example, in case the first living entity 108 is at a front of the queue, the circuitry 202 may be configured to switch to the second field-of-view 304 to detect the second living entity 114, who may be behind the first living entity 108 in the queue. In another embodiment, the circuitry 202 may be configured to switch between the first field-of-view 302 and the second field-of-view 304 at regular intervals (such as every few seconds)

FIG. 3B is a diagram that illustrates an exemplary implementation of the electronic apparatus of FIG. 1, in accordance with an embodiment of the disclosure. FIG. 3B is explained in conjunction with elements from FIGS. 1, 2, and 3A. With reference to FIG. 3B, there is shown an exemplary scenario 300B to illustrate a second mounting configuration of the electronic apparatus 102.

In the exemplary scenario 300B, there is shown the second mounting configuration of the electronic apparatus 102. In an embodiment, the electronic apparatus 102 may be coupled to the object 108A (such as a shoulder area of a garment) associated with the first living entity 108 using a mounting mechanism (such as flexible shoulder mount, a strap with a hook-and-loop fastener, or a strap with a buckle or folding clasp). In an embodiment, the electronic apparatus 102 may include a reflector 310 (for example, a movable mirror or other optical arrangement) that may be coupled to the first sensor 104. The circuitry 202 may be further configured to control a motion of the reflector 310 to change a field of view (such as the first field-of-view 302 or the second field-of-view 304) of the first sensor 104. In an embodiment the motion of the reflector 310 may be changed such that the first sensor 104 captures the field-of-view of about 360 degrees around the first living entity 108. The circuitry 202 may be configured to detect the at least one second living entity (such as the second living entity 114) based on the change in the field of view (such as the first field-of-view 302 or the second field-of-view 304) of the first sensor 104. The circuitry 202 may be configured to control the first sensor 104 to switch between the first field-of-view 302 and the second field-of-view 304. In another embodiment, the first sensor 104 may be configured to capture the field of view about 360 degrees around the first living entity 108. Details of such configuration is further explained in FIG. 3C.

FIG. 3C is a diagram that illustrates an exemplary implementation of the electronic apparatus of FIG. 1, in accordance with an embodiment of the disclosure. FIG. 3C is explained in conjunction with elements from FIGS. 1, 2, 3A, and 3B. With reference to FIG. 3C, there is shown an exemplary scenario 300C to illustrate an exemplary configuration of the electronic apparatus 102.

In the exemplary scenario 300C, there is shown the exemplary configuration of the electronic apparatus 102. In an embodiment, the first sensor 104 may be an omnidirectional sensor (such as the 360-degree camera). The circuitry 202 may be further configured to control the omnidirectional sensor to execute the detection in all directions (including the first direction 306 and the second direction 308) around the first living entity 108. For example, the circuitry 202 may control the omnidirectional sensor to capture the second living entity 114 from a field-of-view (such as the combination of the first field-of-view 302 and the second field-of-view 304) of the omnidirectional sensor. In such scenario, the first angle 302A of the first field-of-view 302 may be substantially same as the second angle 304A of the second field-of-view 304. For example, the first angle 302A and the second angle 304A may be in the range from 170 degrees to 180 degrees. The combination of the first angle 302A and the second angle 304A may form a 360-degree view for the omnidirectional sensor. Based on the control of the field-of-view of the omnidirectional camera, the circuitry 202 may be configured to detect the second living entity 114 and control the output of the notification to the first living entity 108 based on the detection of the second living entity 114 within the set detection range of the first sensor 104. Details of such detection and notification are further described, for example, in FIGS. 4A-4C.

Figure 4C:
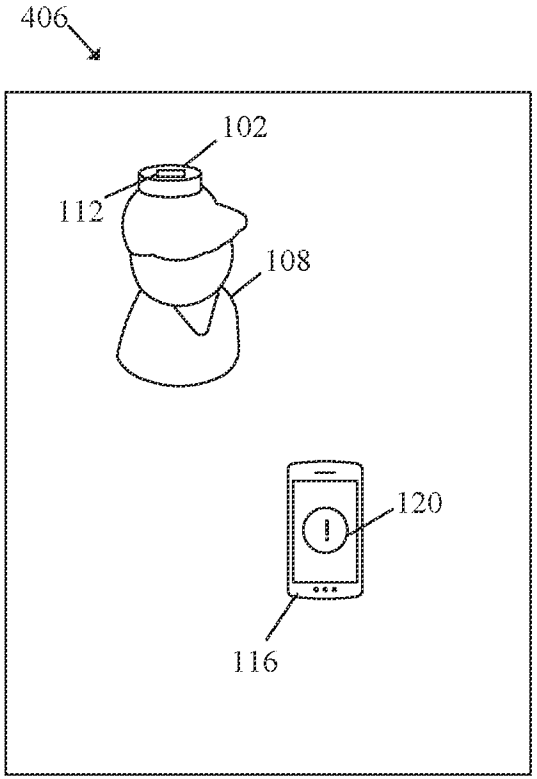
FIGS. 4A-4C are diagrams that collectively illustrate an exemplary scenario to provide a social distancing alert based on a location of a first living entity, in accordance with an embodiment of the disclosure.
Figure 4B:
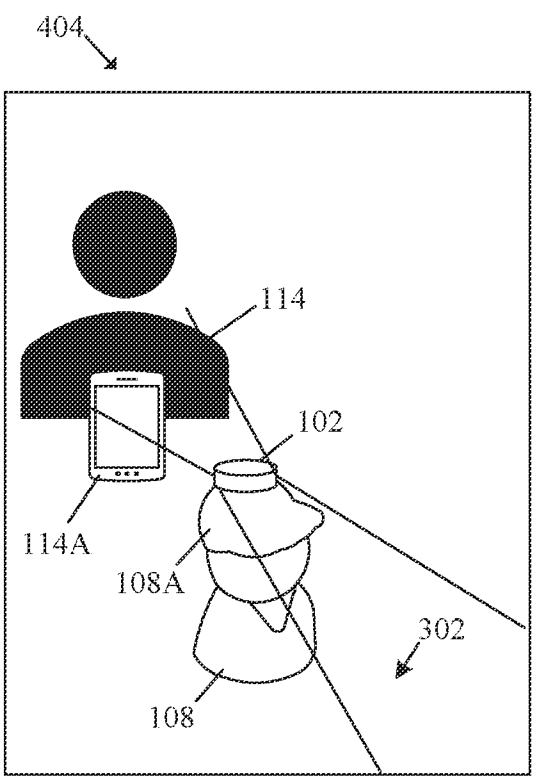
Figure 4A:
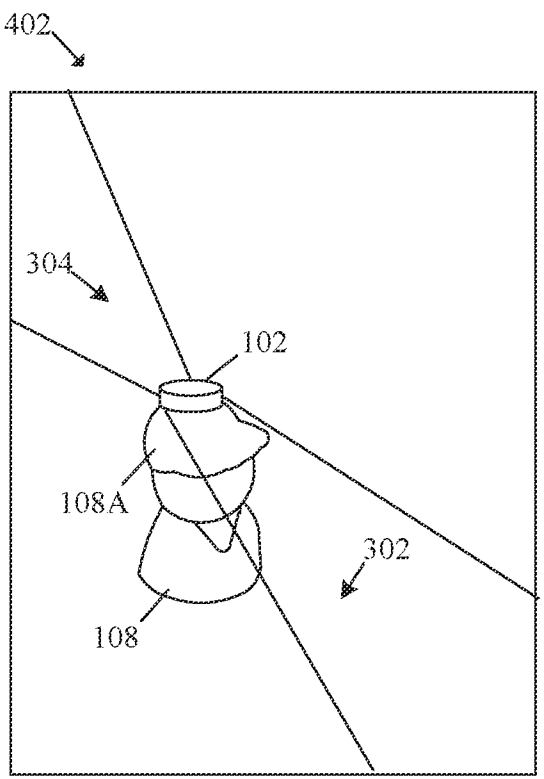

FIG. 4A is a diagram that illustrates an exemplary scenario to provide a social distancing alert based on a location of a first living entity, in accordance with an embodiment of the disclosure. FIG. 4A is explained in conjunction with elements from FIGS. 1, 2, and 3A-3C. With reference to FIG. 4A, there is shown an exemplary scenario 402. With reference to FIG. 4A, there is shown the exemplary scenario 402. In the exemplary scenario 402, first sensor 104 may be mounted on the object 108A associated with the first living entity 108. The circuitry 202 may activate the first sensor 104 and may set the detection range of the first sensor 104 in the first field-of-view 302 and the second field-of-view 304. As shown in FIG. 4A, the first sensor 104 may not detect the second living entity 114 within the set detection range. The circuitry 202 may not output any notification to the first living entity 108.

FIG. 4B is a diagram that illustrates an exemplary scenario to provide a social distancing alert based on a location of a first living entity, in accordance with an embodiment of the disclosure. FIG. 4B is explained in conjunction with elements from FIGS. 1, 2, 3A-3C, and 4A. With reference to FIG. 4B, there is shown an exemplary scenario 404. In the exemplary scenario 404, based on the approach of the second living entity 114 within the detection range of the first sensor 104, the first sensor 104 may detect the second living entity 114. In an example, the first sensor 104 may include a thermal sensor (such as the passive infrared sensor). The circuitry 202 may be further configured to control the first sensor 104 to detect infrared radiation emitted by the at least one second living entity (such as the second living entity 114) located within the set detection range of the first sensor 104. The circuitry 202 may further determine a temperature value based on the detect infrared radiation. The circuitry 202 may compare the determined temperature value with the reference temperature values stored in the memory 204 (shown in FIG. 2). The circuitry 202 may then detect the second living entity 114 within the set detection range of the first sensor 104, based on the comparison of the determined temperature value with stored reference temperature values.

In another embodiment, the first sensor 104 may be the optical sensor. In such a scenario, the circuitry 202 may be further configured to control the optical sensor to transmit a light pulsed in a field of view (such as the first field-of-view 302 or the second field-of-view 304) of the first sensor 104 based on the set detection range of the first sensor 104. The first sensor 104 may receive response signals based on reflection of the transmitted light pulse off the second living entity 114. Based on a time-of-flight between the transmitted light pulse and the received response signals, the first sensor 104 may detect the second living entity 114 within the set detection range of the first sensor 104.

In another embodiment, the first sensor may be the image sensor. In such a scenario, the circuitry 202 may be further configured to control the image sensor to capture an image in a field of view (such as the first field-of-view 302 or the second field-of-view 304) of the first sensor 104 based on the set detection range of the first sensor 104. The circuitry 202 may be configured to execute image segmentation and object detection on the captured image to detect one or more objects (such as the second living entity 114) in the capture image. The circuitry 202 may be configured to execute a time-of-flight technique to determine a distance between the detected one or objects (such as the second living entity 114) and the first sensor 104. In another example, the circuitry 202 may determine the distance between second living entity 114 and the first sensor 104 based on a size of other objects (such as a tree or a vehicle) as background objects in the captured image. Based on the determined distance between the second living entity 114 and the first sensor 104, the circuitry 202 may detect the second living entity 114 within the set detection range of the first sensor 104. In another example, the circuitry 202 may set the focus range of the image sensor based on the set detection range of the first sensor 104, and may determine the second living entity 114 within the set detection range of the first sensor 104 in case the second living entity 114 enters the focus range of the image sensor.

FIG. 4C is a diagram that illustrates an exemplary scenario to provide a social distancing alert based on a location of a first living entity, in accordance with an embodiment of the disclosure. FIG. 4C is explained in conjunction with elements from FIGS. 1, 2, 3A-3C, 4A, and 4B. With reference to FIG. 4C, there is shown an exemplary scenario 406. In the exemplary scenario 406, the circuitry 202 may be configured to control of the notification to the first living entity 108 based on the detection of the second living entity 114 within the detection range, as shown in FIG. 4B. In an embodiment, the circuitry 202 may be further configured to control the output of the notification to the first living entity 108 in case the determined temperature value exceeds a threshold value (such as the stored reference temperature values). In another embodiment, the circuitry 202 may be further configured to control the output of the notification to the first living entity 108 based on the time-of-flight between the transmitted light pulse and the received response signals of the optical sensor. In another embodiment, the circuitry 202 may be further configured to control the output of the notification to the first living entity 108 based on the captured image of the second living entity 114.

As shown in FIG. 4C, the circuitry 202 may be further configured to control the first output device 112 to output the notification as one of a vibration-based notification, an audio-based notification, or a visual notification. In an embodiment, the circuitry 202 may be further configured to control the first output device 112 to output the notification as a combination of the vibration-based notification and the audio-based notification. In another embodiment, the circuitry 202 may be configured to control the second output device 120 of the user device 116 to output the notification as a visual notification on a display of the user device 116. In another embodiment, the circuitry 202 may be configured to control the second output device 120 of the user device 116 to output the notification as a combination of the vibration-based notification and the visual notification. In another embodiment, the circuitry 202 may be further configured to transmit a notification signal to the server 122 in case the determined temperature value exceeds the threshold value. In another embodiment, the server 122 may be configured to relay the transmitted notification to a nearest medical facility (such as the medical facility 124).

Figure 5C:
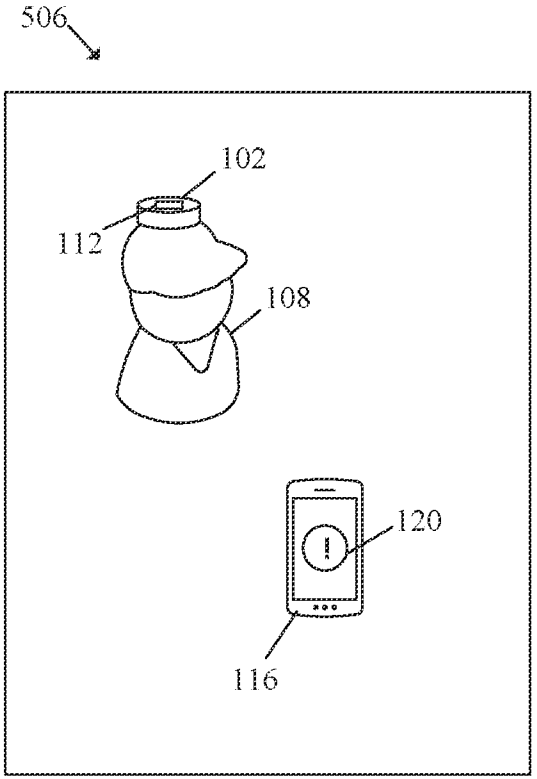
FIGS. 5A-5C are diagrams that collectively illustrate an exemplary scenario to provide a social distancing alert based on a location of a first living entity, in accordance with an embodiment of the disclosure.
Figure 5B:
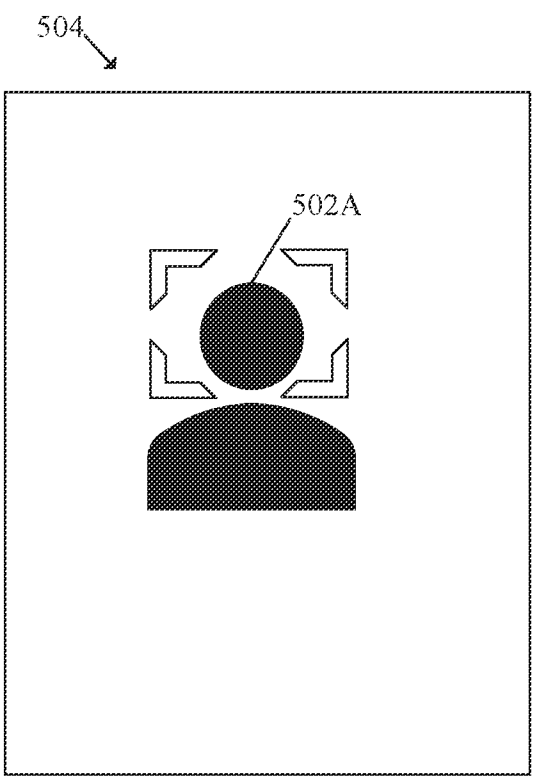
Figure 5A:
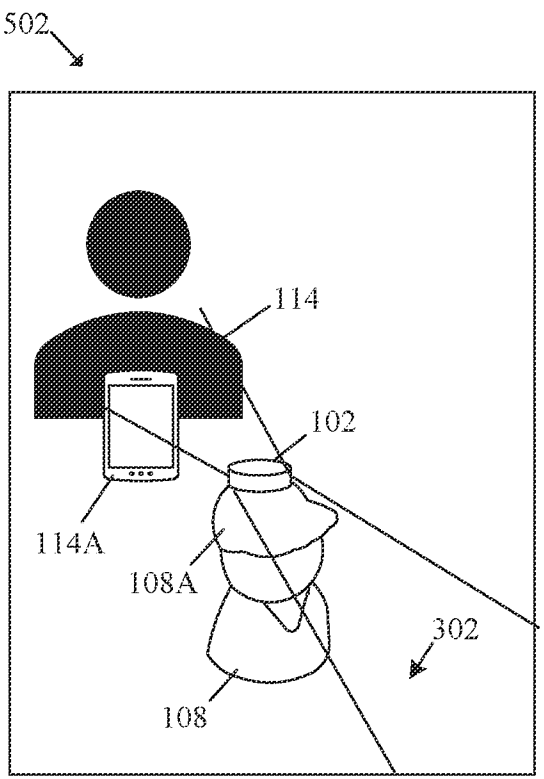

FIG. 5A is a diagram that illustrates an exemplary scenario to provide a social distancing alert based on a location of a first living entity, in accordance with an embodiment of the disclosure. FIG. 5A is explained in conjunction with elements from FIGS. 1, 2, 3A-3C, and 4A-4C. With reference to FIG. 5A, there is shown an exemplary scenario 502.

In the exemplary scenario 502, the first sensor 104 of the electronic apparatus 102 may be the image sensor. The circuitry 202 may be further configured to control the first sensor 104 to capture an image of the second living entity 114. Based on the captured image of the second living entity 114, the circuitry 202 may be configured to compare the captured image with stored reference images in the memory 204 (shown in FIG. 4). Based on the comparison, the circuitry 202 may be configured to detect the second living entity 114 and may determine the distance between the detected second living entity 114 and the image sensor.

Based on the determined distance, the circuitry 202 may detect that the second living entity 114 is within the set detection range. Details of the detection are further explained, for example, in FIG. 5B.

FIG. 5B is a diagram that illustrates an exemplary scenario to provide a social distancing alert based on a location of a first living entity, in accordance with an embodiment of the disclosure. FIG. 5B is explained in conjunction with elements from FIGS. 1, 2, 3A-3C, 4A-4C, and 5A. With reference to FIG. 5B, there is shown an exemplary scenario 504.

In the exemplary scenario 504, the circuitry 202 may be further configured to perform a face recognition from the captured image of the second living entity 114. The circuitry 202 may further control the output of the notification to the first living entity 108 based on a result of the face recognition. For example, based on the face recognition, the circuitry 202 may determine the second living entity 114 as a known living entity by comparison of the recognized face of the second living entity 114 with the stored images of living entities (such a family and friends known to the first living entity 108) in the memory 204. Based on the determination of the second living entity 114 as the known living entity, the circuitry 202 may not output the notification to the first living entity 108. In case the recognized face of the second living entity 114 does not match with the pre-stored images of living entities known to the first living entity 108, the circuitry 202 may output the notification to the first living entity 108.

In an embodiment, the user device 114A of the second living entity 114 may include a Radio Frequency Identification Device (RFID) tag. In another embodiment, the second living entity 114 may carry an electronic apparatus similar to the electronic apparatus 102 associated with the first living entity 108. The electronic apparatus carried by the second living entity 114 may include an RFID tag. The first sensor 104 (such as the RFID reader) may be configured to detect the RFID tag. The circuitry 202 may identify the second living entity 114 as a known living entity in case an identifier associated with the detected RFID tag is stored in the memory 204. The circuitry 202 may not output the notification to the first living entity 108 based on the identification of the second living entity 114 as the known living entity. Details of the notification are further explained, for example, in FIG. 5C.

FIG. 5C is a diagram that illustrates an exemplary scenario to provide a social distancing alert based on a location of a first living entity, in accordance with an embodiment of the disclosure. FIG. 5C is explained in conjunction with elements from FIGS. 1, 2, 3A-3C, 4A-4C, 5A, and 5B. With reference to FIG. 5C, there is shown an exemplary scenario 506.

In the exemplary scenario 506, based on the detection of the second living entity 114 from the captured image of the first sensor 104 (such as the image sensor), the circuitry 202 may be configured to control of the notification to the first living entity 108. In an embodiment, the circuitry 202 may be further configured to control the first output device 112 to output the notification as one of a vibration-based notification, an audio-based notification, or a visual notification. In another embodiment, the circuitry 202 may be further configured to control the second output device 120 of the user device 116 to output the notification as a vibration-based notification or a visual notification. Details of the notification are further explained, for example, in FIGS. 6A-6C.

Figures 6A, 6B, 6C:
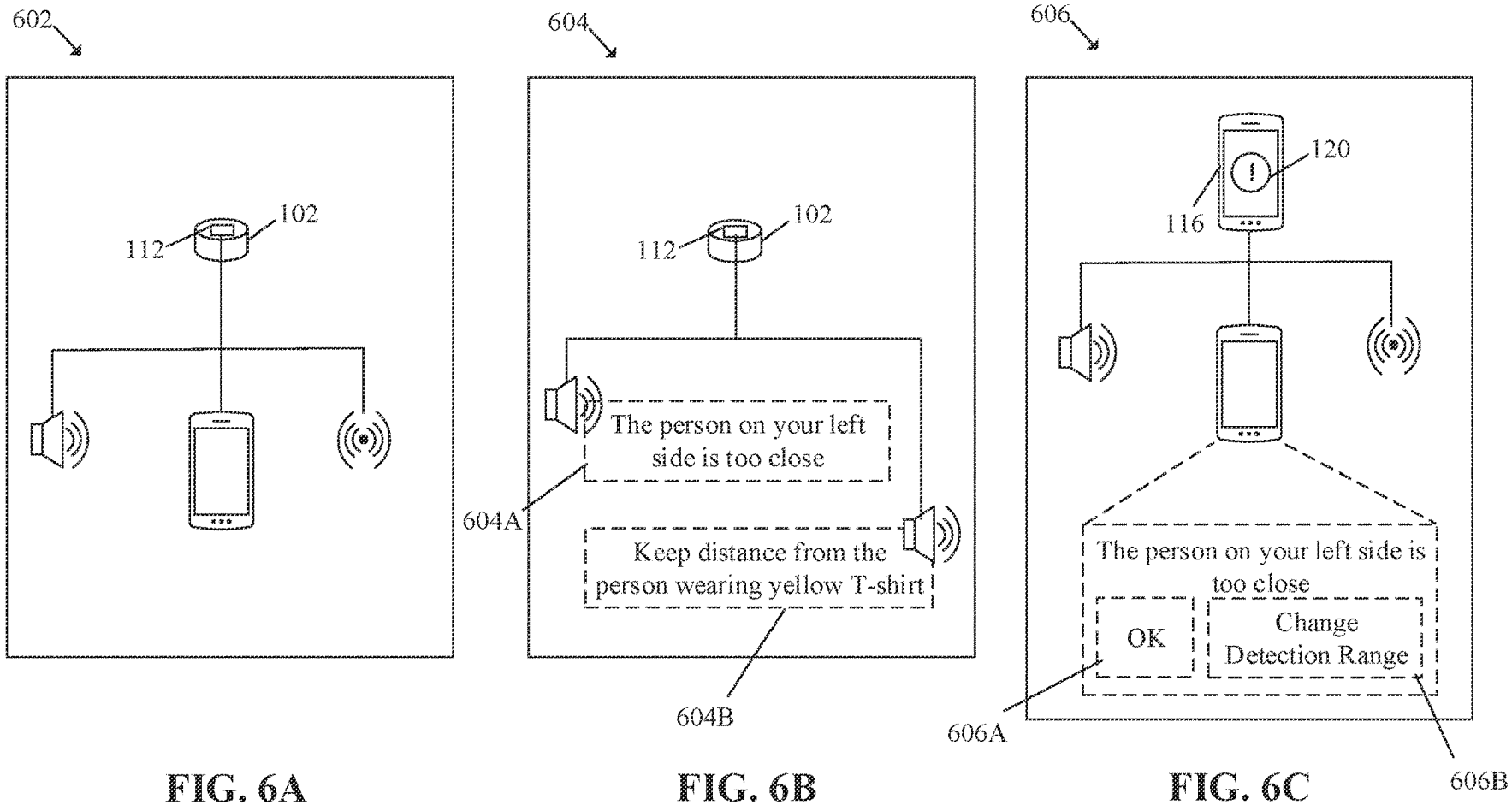
FIGS. 6A-6C are diagrams that illustrate exemplary notifications of the electronic apparatus to provide a social distancing alert, in accordance with an embodiment of the disclosure.

FIG. 6A is a diagram that illustrates an exemplary notification of the electronic apparatus to provide a social distancing alert, in accordance with an embodiment of the disclosure. FIG. 6A is explained in conjunction with elements from FIGS. 1, 2, 3A-3C, 4A-4C, and 5A-5C. With reference to FIG. 6A, there is shown an exemplary scenario 602. In the exemplary scenario 602, the first output device 112 of the electronic apparatus 102 may comprise a suitable I/O device (such as a speaker, a display screen, or a vibration actuator) to provide at least one of the audio-based notification, the visual notification, or the vibration-based notification, respectively.

FIG. 6B is a diagram that illustrates an exemplary notification of the electronic apparatus to provide a social distancing alert, in accordance with an embodiment of the disclosure. FIG. 6B is explained in conjunction with elements from FIGS. 1, 2, 3A-3C, 4A-4C, 5A-5C, and 6A. With reference to FIG. 6B, there is shown an exemplary scenario 604. In the exemplary scenario 604, the circuitry 202 may acquire, from the first sensor 104, directional information (such as the first direction 306 or the second direction 308) associated with the detection of the at least one second living entity (such as the second living entity 114. Based on the acquired directional information, the circuitry 202 may be configured to output a customized audio message 604A to the first living entity 108 as the notification. The circuitry 202 may generate the customized audio message 604A (such as a synthesized speech message) based on the acquired directional information associated with the detection of second living entity 114. For example, in case directional information indicates that the second living entity 114 is approaching the first living entity 108 from a left direction, the circuitry 202 may control the first output device 112 to output the customized audio message 604A (such as "the person on your left side is too close") as the notification.

In another embodiment, the circuitry 202 may further acquire, from the first sensor 104, visual appearance associated with the detected second living entity 114. The visual appearance information comprises visual attributes (such as a height, a color of garment, etc.) of the second living entity 114. Based on the acquired visual appearance information, the circuitry 202 may further output a customized audio message 604B to the first living entity 108 as the notification. The circuitry 202 may generate the customized audio message 604B (such as the synthesized speech message) based on the acquired visual appearance information (such as a height, a color of garment, etc.) associated with the detected second living entity 114. For example, in case visual appearance information indicates that the second living entity 114, approaching the first living entity 108, is wearing a yellow T-shirt garment, the circuitry 202 may control the first output device 112 to output the customized audio message 604B (such as "Keep distance from the person wearing yellow T-shirt") as the notification.

FIG. 6C is a diagram that illustrates an exemplary notification of the electronic apparatus to provide a social distancing alert, in accordance with an embodiment of the disclosure. FIG. 6C is explained in conjunction with elements from FIGS. 1, 2, 3A-3C, 4A-4C, 5A-5C, 6A, and 6B. With reference to FIG. 6C, there is shown an exemplary scenario 606. In the exemplary scenario 606, the circuitry 202 may be further configured to transmit a notification signal to the user device 116 associated with the first living entity 108, based on the detection of the second living entity 114 within the set detection range of the first sensor 104. In another embodiment, the circuitry may be further configured to transmit a notification signal to the user device 114A associated with the second living entity 114, based on the detection of the second living entity 114 within the set detection range of the first sensor 104.

In an embodiment, the application installed on the user device 116 may display a user interface to output the notification, based on the notification signal received from the electronic apparatus 102. The user interface may include a first option 606A (such as "OK") to dismiss the notification) and a second option 606B (such as "Change Detection Range") to change the detection range of the first sensor 104. In an embodiment, the second option 606B to change the detection range of the first sensor 104 may be provided to avoid false positives in the detection of the second living entity 114. Based on the user selection, the circuitry 202 may change the detection range of the first sensor 104. For example, in case the second option 606B is selected, the user device 116 may display the plurality of detection ranges 106 for user selection or may display an empty field for entry of a custom detection range (such as 5.5 feet). The circuitry 202 may receive the user selection from the user device 116, and may change the detection range of the first sensor 104.

Figures 7A, 7B, 7C, 7D:
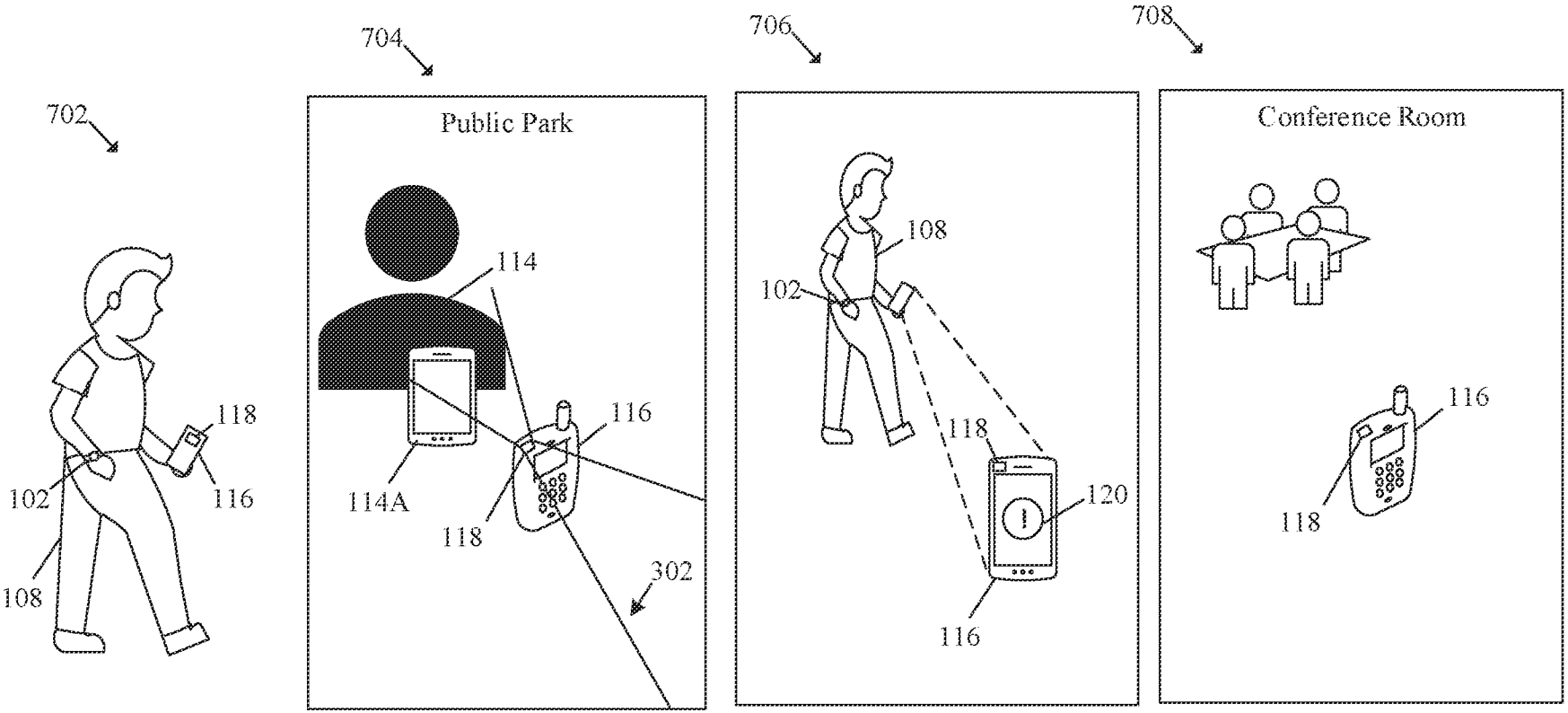
FIGS. 7A-7D are diagrams that collectively illustrate an exemplary scenario to provide a social distancing alert based on a location of a first living entity, in accordance with an embodiment of the disclosure.

FIG. 7A is a diagram that illustrates an exemplary scenario to provide a social distancing alert based on a location of a first living entity, in accordance with an embodiment of the disclosure. FIG. 7A is explained in conjunction with elements from FIGS. 1, 2, 3A-3C, 4A-4C, 5A-5C, and 6A-6C. With reference to FIG. 7A, there is shown an exemplary scenario 702. In the exemplary scenario 702, the electronic apparatus 102 may be mounted on the first living entity 108. For example, the electronic apparatus 102 may implemented as the smart wearable apparatus and may be mounted on a part (such as a left hand) of the first living entity 108. In the exemplary scenario 702, the user device 116 may be implemented as the mobile device and may be carried by the first living entity 108.

FIG. 7B is a diagram that illustrates an exemplary scenario to provide a social distancing alert based on a location of a first living entity, in accordance with an embodiment of the disclosure. FIG. 7B is explained in conjunction with elements from FIGS. 1, 2, 3A-3C, 4A-4C, 5A-5C, 6A-6C, and 7A. With reference to FIG. 7B, there is shown an exemplary scenario 704. In the exemplary scenario 704, the second sensor 118 (such as the in-built front camera and/or rear camera) of the user device 116 may be activated for a first time period that may be set by the timer 208. The circuitry 202 may be further configured to set the detection range of the second sensor 118 of the user device 116 for the first time period. The circuitry 202 may be further configured to detect at least one second living entity (such as the second living entity 114) based on the set detection range of the second sensor 118. For example, in case the first living entity 108 is at an outdoor location (such as a park), the circuitry 202 may acquire a geo-location of the park from the location sensor of the user device 116. The circuitry 202 may activate the second sensor 118 for the first time period for the detection of the second living entity 114 during the first time period. In an embodiment, the first time period may be set based on user input or based on user behavior history associated with the first living entity 108. For example, the circuitry 202 may determine that the first living entity 108 may visit the park between 7 AM to 8 AM everyday based on the user behavior history or based on location history associated with the first living entity 108. The circuitry 202 may set the first time period (for example, 7 AM to 8 AM) for the activation of the second sensor 118 based on the user behavior history associated with the first living entity 108. In case the second living entity 114 is detected within the set detection range of the second sensor 118 during the first time period ((for example, 7 AM to 8 AM), the circuitry 202 may output a notification to the first living entity 108 to maintain the minimum distance from the second living entity 114.

FIG. 7C is a diagram that illustrates an exemplary scenario to provide a social distancing alert based on a location of a first living entity, in accordance with an embodiment of the disclosure. FIG. 7C is explained in conjunction with elements from FIGS. 1, 2, 3A-3C, 4A-4C, 5A-5C, 6A-6C, 7A, and 7B. With reference to FIG. 7C, there is shown an exemplary scenario 706. In the exemplary scenario 706, the circuitry 202 may control the first output device 112 of the electronic apparatus 102 or the second output device 120 of the user device 116 to output of the notification to the first living entity 108 based on the detected at least one second living entity (such as the second living entity 114). The notification may be output by at least one of the first output device 112 of the electronic apparatus 102, the second output device 120 of the user device 116, or the user device 114A associated with the second living entity 114, as described in FIGS. 6A-6C.

FIG. 7D is a diagram that illustrates an exemplary scenario to provide a social distancing alert based on a location of a first living entity, in accordance with an embodiment of the disclosure. FIG. 7D is explained in conjunction with elements from FIGS. 1, 2, 3A-3C, 4A-4C, 5A-5C, 6A-6C, 7A, 7B, and 7C. With reference to FIG. 7D, there is shown an exemplary scenario 708. In the exemplary scenario 708, the circuitry 202 may be configured to deactivate the second sensor 118 of the user device 116 after completion of the first time period set by the timer 208. In an example, the circuitry 202 may receive information associated with a change in the location of the first living entity 108. Based on the received information, the circuitry 202 may deactivate the second sensor 118 based on a movement of the first living entity 108 from the park to an indoor location (such as a living room or a conference room), irrespective of the expiration of the timer 208. When the location sensor of the user device 116 detects the change in the geo-location of the first living entity 108 to an indoor location (such as the living room or the conference room), the circuitry 202 may control the second sensor 118 to deactivate the second sensor 118, to avoid unwanted notifications when the first living entity 108 is in the living room or when the first living entity 108 is surrounded by known living entities (based on the stored images of living entities in the memory 204) in the conference room. In another embodiment, the detection range and/or the deactivation of the second sensor 118 may be manually controlled based on the user input (such as based on the first option 606A or the second option 606B, as described, for example, in FIG. 6C) using the application installed on the user device 116. In another embodiment, the circuitry 202 may be configured to place the first sensor 104 and the first output device 112 of the electronic apparatus 102 in a standby mode in case the geo-location of the first living entity 108 to is an indoor location (such as the living room) to minimize power consumption of the electronic apparatus 102.

Figure 8:
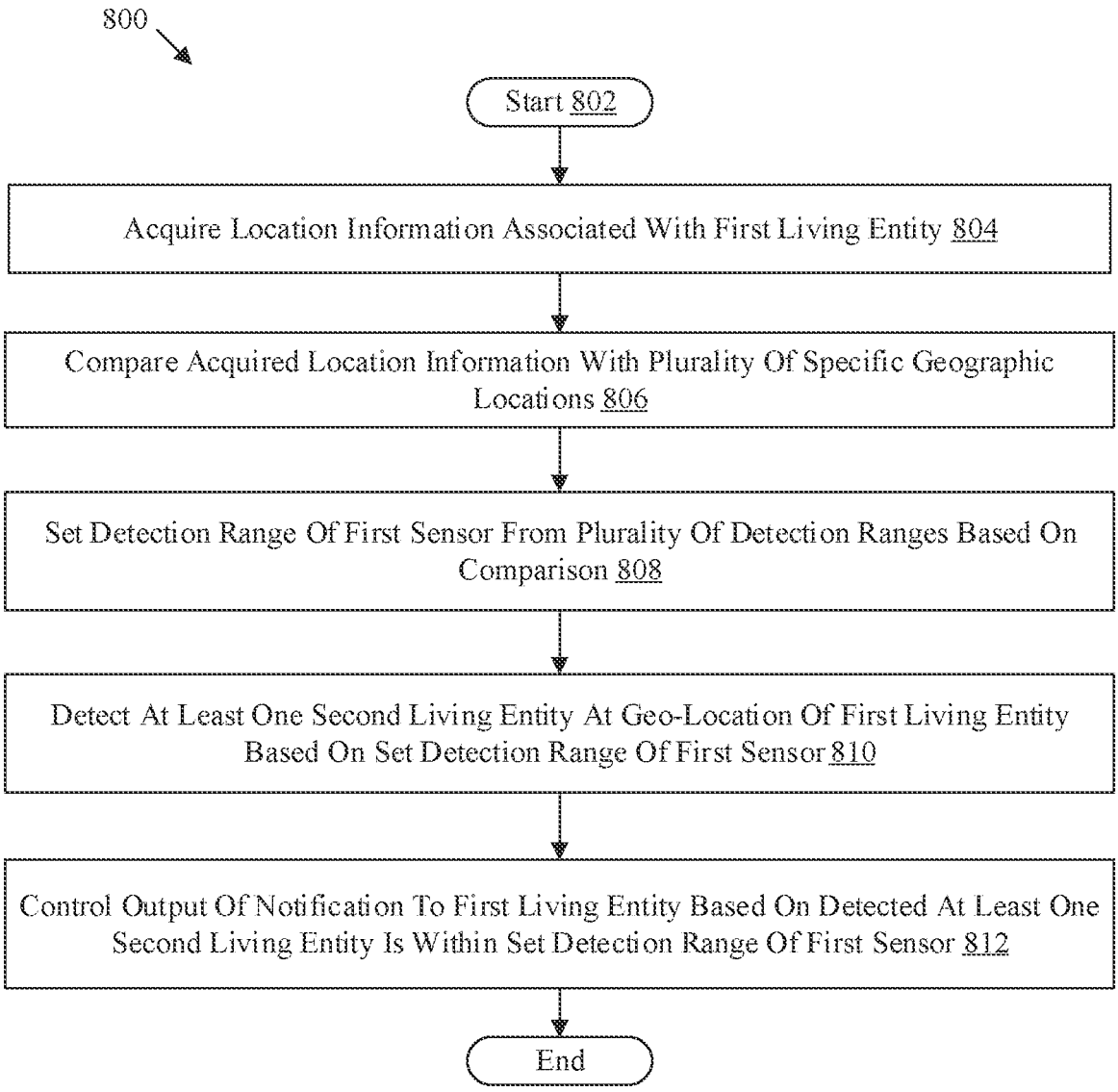
FIG. 8 is a flowchart that illustrates exemplary operations to provide a social distancing alert based on a location of a first living entity, in accordance with an embodiment of the disclosure.

FIG. 8 is a flowchart that illustrates exemplary operations to provide a social distancing alert based on a location of a first living entity in the electronic apparatus of FIG. 1, in accordance with an embodiment of the disclosure. FIG. 8 is explained in conjunction with elements from FIGS. 1, 2, 3A-3C, 4A-4B, 5A-5C, 6A-6C and 7A-7D. With reference to FIG. 8, there is shown a flowchart 800 that depicts a method to provide the social distancing alert based on the electronic apparatus 102 of FIG. 1. The method illustrated in the flowchart 800 may start from 802.

At 804, the location information associated with the first living entity 108 may be acquired. In an embodiment, the electronic apparatus 102 may acquire the location information associated with first living entity from the location sensor, as described in FIG.

At 806, the acquired location information may be compared with the plurality of specific geographic locations 110. In an embodiment, the electronic apparatus 102 may compare the acquired location information with the plurality of specific geographic locations 110, as described in FIGS. 1 and 2.

At 808, the detection range of the first sensor 104 may be set from the plurality of detection ranges 106 based on the comparison. In an embodiment, the electronic apparatus 102 may set the detection range of the first sensor 104 from the plurality of detection ranges 106 based on the comparison, as described in FIGS. 4A-4C.

At 810, at least one second living entity (such as the second living entity 114) at the geo-location of the first living entity 108 may be detected, based on the set detection range of first sensor 104. In an embodiment, the electronic apparatus 102 may detect at least one second living entity (such as the second living entity 114) at the geo-location of the first living entity 108, based on the set detection range of first sensor 104, as described in FIGS. 4A-4C and 5A-5C.

At 812, the output of a notification to the first living entity 108 may be controlled based on the detected second living entity 114 is within the set detection range of the first sensor 104. In an embodiment, the electronic apparatus 102 may control the output of the notification to the first living entity 108 based on the detected second living entity 114 is within the set detection range of the first sensor 104, as described in FIGS. 4A-4C, 5A-5C, and 6A-6C. Control may pass to end.

The flowchart 800 is illustrated as discrete operations, such as 802, 804, 806, 808, and 810. However, in certain embodiments, such discrete operations may be further divided into additional operations, combined into fewer operations, or eliminated, or rearranged depending on the implementation without detracting from the essence of the disclosed embodiments.

Various embodiments of the disclosure may provide a non-transitory computer-readable medium and/or storage medium, and/or a non-transitory machine readable medium and/or storage medium stored thereon, a set of instructions executable by a machine and/or a computer (for example the electronic apparatus 102 or the circuitry 202) to provide the social distancing alert based on the location of a first living entity. The set of instructions may be executable by the machine and/or the computer (for example the electronic apparatus 102 or the circuitry 202) to perform operations that may include acquisition of location information associated with the first living entity 108, comparison of the acquired location information with the plurality of specific geographic locations 110 (for example, stored in the memory 204), setting of the detection range of the first sensor 104 from the plurality of detection ranges 106 based on the comparison, detection of the at least one second living entity (such as the second living entity 114) at the geo-location (such as the first geo-location 110A) of the first living entity 108 based on the set detection range of the first sensor 104, and control of the output of the notification to the first living entity 108 based on the detected at least one second living entity (such as the second living entity 114) that may be within the set detection range of the first sensor 104. The execution of operations may be further described, in FIGS. 4A-4C, 5A-5C, 6A-6C, and 7A-7D.

Exemplary aspects of the disclosure may include an electronic apparatus (such as, the electronic apparatus 102) that may a first sensor (such as the first sensor 104) that may be mountable on one of the first living entity (such as the first living entity 108) or an object (such as the object 108A) worn by the first living entity. 108 The electronic apparatus may further include a memory (such as the memory 204) that may be configured to store information related to a plurality of detection ranges (such as the plurality of detection ranges 106) of the first sensor 104 with respect to a plurality of specific geographic locations (such as plurality of specific geographic locations 110). Each of the plurality of detection ranges 106 may correspond to a specific geographic location of the plurality of specific geographic locations 110. The electronic apparatus may further include circuitry (such as, the circuitry 202). The circuitry 202 may be configured to acquire location information associated with the first living entity 108. The location information may comprise a geo-location of the first living entity 108. The circuitry 202 may be configured to compare the acquired location information with the plurality of specific geographic locations 110. The circuitry 202 may set the detection range of the first sensor from the plurality of detection ranges 106 based on the comparison. The circuitry 202 may detect at least one second living entity (such as the second living entity 114) at the geo-location of the first living entity 108 based on the set detection range of the first sensor 104. The circuitry 202 may control output of a notification to the first living entity 108 based on the detected second living entity 114 is within the set detection range of the first sensor 104.

In accordance with an embodiment, the circuitry 202 may be communicably coupled to a user device (such as the user device 116) associated with the first living entity 108. The circuitry 202 may be configured to receive an input from the user device 116. The input may comprise the detection range of the first sensor 104. The circuitry 202 may be configured to change the detection range of the first sensor 104 based on the received input.

In accordance with an embodiment, the circuitry 202 may be communicably coupled to the user device 116 associated with the first living entity 108. The user device 116 may comprise a second sensor (such as the second sensor 118). The circuitry 202 may be configured to activate the second sensor 118 of the user device 116 for a first time period. The circuitry 202 may be configured to set a detection range of the second sensor 118 of the user device 116 for the first time period based on the comparison. The circuitry 202 may be configured to detect the second living entity 114 based on the set detection range of the second sensor 118. The circuitry 202 may be configured to control the output of the notification to the first living entity 108 based on the detected second living entity 114. The circuitry 202 may be configured to deactivate the second sensor 118 of the user device 116 upon completion of the first time period.

In accordance with an embodiment, the circuitry 202 may be configured to control the first sensor 104 to switch between a first field-of-view (such as the first field-of-view 302) and a second field-of-view (such as the first field-of-view 304). The circuitry 202 may be configured to change a direction of the detection of the second living entity 114 based on the switch between the first field-of-view 302 and the second field-of-view 304.

In accordance with an embodiment, the electronic apparatus 102 may further comprise a first output device (such as the first output device 112). The circuitry 202 may be communicably coupled with the user device 116 associated with the first living entity 108. The user device 116 may comprise a second output device (such as the second output device 120). The circuitry 202 may be further configured to control at least one of the first output device 112 or the second output device 120 to output the notification. The first output device 112 may comprise at least one of a display device, a first speaker, or a first vibration actuator. The second output device 120 may comprise at least one of a second speaker or a second vibration actuator.

In accordance with an embodiment, the circuitry 202 may be configured to transmit a notification signal to a user device (such as the user device 114A) associated with the second living entity 114 at the geo-location of the first living entity 108, based on the detection of the second living entity 114 within the set detection range of the first sensor 104.

In accordance with an embodiment, the first sensor 104 may comprise a passive infrared sensor. The memory 204 may be further configured to store reference temperature values associated with living entities. The circuitry 202 may be configured to control the first sensor 104 to detect infrared radiation emitted by the second living entity 114 located within the set detection range. The circuitry 202 may be configured to determine a temperature value based on the detect infrared radiation. The circuitry 202 may be configured to compare the determined temperature value with the stored reference temperature values. The circuitry 202 may be configured to detect the second living entity 114 is within the set detection range based on the comparison of the determined temperature value with stored reference temperature values.

In accordance with an embodiment, the circuitry 202 may be configured to control the output of the notification to the first living entity 108 based on the determined temperature value that exceeds a threshold value. In accordance with an embodiment, the circuitry 202 may be configured to transmit a notification signal to a server (such as the server 122) associated with at least one medical facility (such as the medical facility 124) based on the determined temperature value that exceeds the threshold value.

In accordance with an embodiment, the first sensor 104 may comprise an image sensor. The memory 204 may be further configured to store reference images associated with living entities. The circuitry 202 may be configured to control the first sensor 104 to capture an image of the second living entity 114. The circuitry 202 may be configured to compare the captured image with stored reference images. The circuitry 202 may be configured to determine a distance of the second living entity 114 from the first sensor 104. The circuitry 202 may be configured to detect the second living entity 114 is within the set detection range of the first sensor 104 based on the determined distance.

In accordance with an embodiment, the circuitry 202 may be configured to perform face recognition from the captured image of the second living entity 114. The circuitry 202 may be configured to control the output of the notification to the first living entity based on a result of the face recognition.

In accordance with an embodiment, the circuitry 202 may be configured to acquire, from the first sensor 104, directional information associated with the detection of the second living entity 114. The circuitry 202 may be configured to output a customized audio message to the first living entity 108 as the notification. The customized audio message may be based on the acquired directional information associated with the detection of the second living entity 114.

In accordance with an embodiment, the circuitry 202 may be configured to acquire, from the first sensor 104, visual appearance information associated with the detected second living entity 114. The visual appearance information may comprise visual attributes of the second living entity 114. The circuitry 202 may be configured to output a customized audio message to the first living entity 108 as the notification. The customized audio message may be based on the acquired visual appearance information associated with the detected second living entity 114.

In accordance with an embodiment, the circuitry 202 may be configured to control the output of the notification to the first living entity 108 based on a determination that the second living entity 114 may be approaching the first living entity 108 within the set detection range of the first sensor 104.

In accordance with an embodiment, the first sensor 104 may be an omnidirectional sensor. The circuitry 202 may be configured to control the omnidirectional sensor to execute the detection in all directions around the first living entity 108.

In accordance with an embodiment, the electronic apparatus 102 may further comprise a reflector (such as the reflector 310) coupled to the first sensor 104. The circuitry 202 may be further configured to control a motion of the reflector 310 to change a field of view of the first sensor 104 about 360 degrees around the first living entity 108. The circuitry 202 may be further configured to detect the second living entity 114 based on the change in the field of view of the first sensor 104.

In accordance with an embodiment, the first sensor may be an optical sensor. The circuitry 202 may be further configured to control the optical sensor to transmit a pulsed illumination (such as a light pulse) in a field of view of the first sensor 104 based on the set detection range of the first sensor 104. The circuitry 202 may be further configured to receive response signals based on the transmitted pulsed illumination. The circuitry 202 may be further configured to control detect the second living entity 114 within the set detection range of the first sensor 104 based on the received response signals.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted for carrying out the methods described herein may be suited. A combination of hardware and software may be a general-purpose computer system with a computer program that, when loaded and executed, may control the computer system such that it carries out the methods described herein. The present disclosure may be realized in hardware that includes a portion of an integrated circuit that also performs other functions. It may be understood that, depending on the embodiment, some of the steps described above may be eliminated, while other additional steps may be added, and the sequence of steps may be changed.

The present disclosure may also be embedded in a computer program product, which includes all the features that enable the implementation of the methods described herein, and which when loaded in a computer system is able to carry out these methods. Computer program, in the present context, means any expression, in any language, code or notation, of a set of instructions intended to cause a system with an information processing capability to perform a particular function either directly, or after either or both of the following: a) conversion to another language, code or notation; b) reproduction in a different material form.

While the present disclosure has been described with reference to certain embodiments, it will be understood by those skilled in the art that various changes may be made, and equivalents may be substituted without departing from the scope of the present disclosure. In addition, many modifications may be made to adapt a situation or material to the teachings of the present disclosure without departing from its scope. Therefore, it is intended that the present disclosure is not limited to the embodiment disclosed, but that the present disclosure will include all embodiments that fall within the scope of the appended claims.

What is claimed is:

1. An electronic apparatus, comprising:

a first sensor, wherein the first sensor is mountable on one of a first living entity or an object worn by the first living entity;

a memory configured to store information related to a plurality of detection ranges of the first sensor with respect to a plurality of specific geographic locations, wherein each of the plurality of detection ranges corresponds to a specific geographic location of the plurality of specific geographic locations; and circuitry communicably coupled with the first sensor, wherein the circuitry is configured to:

acquire location information associated with the first living entity, wherein the location information comprises a geo-location of the first living entity;

compare the acquired location information with the plurality of specific geographic locations;

set the detection range of the first sensor from the plurality of detection ranges based on the comparison;

detect at least one second living entity at the geo-location of the first living entity based on the set detection range of the first sensor; and control output of a notification to the first living entity based on the detected at least one second living entity is within the set detection range of the first sensor.

2. The electronic apparatus according to claim 1, wherein the circuitry is communicably coupled to a user device associated with the first living entity, and the circuitry is further configured to:

receive an input from the user device, wherein the input comprises the detection range of the first sensor; and change the detection range of the first sensor based on the received input.

3. The electronic apparatus according to claim 1, wherein the circuitry is communicably coupled to a user device associated with the first living entity, the user device comprises a second sensor, and the circuitry is further configured to:

activate the second sensor of the user device for a first time period;

set a detection range of the second sensor of the user device for the first time period, based on the comparison;

detect the at least one second living entity based on the set detection range of the second sensor;

control the output of the notification to the first living entity based on the detected at least one second living entity; and deactivate the second sensor of the user device upon completion of the first time period.

4. The electronic apparatus according to claim 1, wherein the circuitry is further configured to:

control the first sensor to switch between a first field-of-view and a second field-of-view; and change a direction of the detection of the at least one second living entity based on the switch between the first field-of-view and the second field-of-view.

5. The electronic apparatus according to claim 1, further comprising a first output device, wherein the circuitry is further communicably coupled with a user device associated with the first living entity, the user device comprises a second output device, and the circuitry is further configured to control one of the first output device or the second output device to output the notification, wherein the first output device comprises at least one of a display device, a first speaker, or a first vibration actuator, and the second output device comprises at least one of a second speaker or a second vibration actuator.

6. The electronic apparatus according to claim 1, wherein the circuitry is configured to transmit a notification signal to a user device associated with the at least one second living entity at the geo-location of the first living entity, based on the detection of the at least one second living entity within the set detection range of the first sensor.

7. The electronic apparatus according to claim 1, wherein the first sensor comprises a passive infrared sensor, the memory is further configured to store reference temperature values associated with living entities, and the circuitry is further configured to:

control the first sensor to detect infrared radiation emitted by the at least one second living entity located within the set detection range;

determine a temperature value based on the detect infrared radiation;

compare the determined temperature value with the stored reference temperature values; and detect the at least one second living entity is within the set detection range based on the comparison of the determined temperature value with stored reference temperature values.

8. The electronic apparatus according to claim 7, wherein the circuitry is further configured to control the output of the notification to the first living entity based on the determined temperature value exceeds a threshold value.

9. The electronic apparatus according to claim 8, wherein the circuitry is configured to transmit a notification signal to a server associated with at least one medical facility based on the determined temperature value exceeds the threshold value.

10. The electronic apparatus according to claim 1, wherein the first sensor comprises an image sensor, the memory is further configured to store reference images associated with living entities, and the circuitry is further configured to:

control the first sensor to capture an image of the at least one second living entity;

compare the captured image with stored reference images;

determine a distance of the at least one second living entity from the first sensor; and detect the at least one second living entity is within the set detection range based on the determined distance.

11. The electronic apparatus according to claim 10, wherein the circuitry is further configured to:

perform face recognition from the captured image of the at least one second living entity; and control the output of the notification to the first living entity based on a result of the face recognition.

12. The electronic apparatus according to claim 1, wherein the circuitry is further configured to:

acquire, from the first sensor, directional information associated with the detection of the at least one second living entity; and output a customized audio message to the first living entity as the notification, wherein the customized audio message is based on the acquired directional information associated with the detection of the at least one second living entity.

13. The electronic apparatus according to claim 1, wherein the circuitry is further configured to:

acquire, from the first sensor, visual appearance information associated with the detected at least one second living entity, wherein the visual appearance information comprises visual attributes of the at least one second living entity; and output a customized audio message to the first living entity as the notification, wherein the customized audio message is based on the acquired visual appearance information associated with the detected at least one second living entity.

14. The electronic apparatus according to claim 1, wherein the circuitry is further configured to control the output of the notification to the first living entity based on a determination that the at least one second living entity is approaching the first living entity within the set detection range of the first sensor.

15. The electronic apparatus according to claim 1, wherein the first sensor is an omnidirectional sensor, and the circuitry is further configured to control the omnidirectional sensor to execute the detection in all directions around the first living entity.

16. The electronic apparatus according to claim 1, further comprising a reflector coupled to the first sensor, wherein the circuitry is further configured to:

control a motion of the reflector to change a field of view of the first sensor about 360 degrees around the first living entity; and detect the at least one second living entity based on the change in the field of view of the first sensor.

17. The electronic apparatus according to claim 1, wherein the first sensor is an optical sensor, and the circuitry is further configured to:

control the optical sensor to transmit a pulsed illumination in a field of view of the first sensor based on the set detection range of the first sensor;

receive response signals based on the transmitted pulsed illumination; and detect the at least one second living entity within the set detection range of the first sensor based on the received response signals.

18. A method, comprising:

in an electronic apparatus comprising a first sensor mountable on one of a first living entity or an object worn by the first living entity, and a memory configured to store information related to a plurality of detection ranges of the first sensor with respect to a plurality of specific geographic locations, wherein each of the plurality of detection ranges corresponds to a specific geographic location of the plurality of specific geographic locations;

acquiring location information associated with the first living entity, wherein the location information comprises a geo-location of the first living entity;

comparing the acquired location information with the plurality of specific geographic locations;

setting the detection range of the first sensor from the plurality of detection ranges based on the comparison;

detecting at least one second living entity at the geo-location of the first living entity based on the set detection range of the first sensor; and controlling output of a notification to the first living entity based on the detected at least one second living entity is within the set detection range of the first sensor.

19. The method according to claim 18, wherein the electronic apparatus is communicably coupled to a user device associated with the first living entity, and the method further comprising:

receiving an input from the user device, wherein the input comprises the detection range of the first sensor; and changing the detection range of the first sensor based on the received input.

20. A non-transitory computer-readable medium having stored thereon, computer-executable instructions which, when executed by an electronic apparatus, cause the electronic apparatus to execute operations, the operations comprising:

storing, in a memory, information related to a plurality of detection ranges of a first sensor with respect to a plurality of specific geographic locations, wherein each of the plurality of detection ranges corresponds to a specific geographic location of the plurality of specific geographic locations, and the first sensor is mountable on one of a first living entity or an object worn by the first living entity;

acquiring location information associated with the first living entity, wherein the location information comprises a geo-location of the first living entity;

comparing the acquired location information with the plurality of specific geographic locations;

setting the detection range of the first sensor from the plurality of detection ranges based on the comparison;

detecting at least one second living entity at the geo-location of the first living entity based on the set detection range of the first sensor; and controlling output of a notification to the first living entity based on the detected at least one second living entity is within the set detection range of the first sensor.

* * * * *